US011495180B2

(12) United States Patent
Kawachi et al.

(10) Patent No.: US 11,495,180 B2
(45) Date of Patent: Nov. 8, 2022

(54) DISPLAY DEVICE AND METHOD OF CONTROLLING THE SAME

(71) Applicants: Wuhan Tianma Micro-Electronics Co., Ltd., Wuhan (CN); TIANMA JAPAN, LTD., Kanagawa (JP)

(72) Inventors: Genshiro Kawachi, Kanagawa (JP); Masamichi Shimoda, Kanagawa (JP); Yoshihiro Nonaka, Kanagawa (JP); Jiro Yanase, Kanagawa (JP)

(73) Assignees: Wuhan Tianma Micro-Electronics Co., Ltd., Wuhan (CN); TIANMA JAPAN, LTD., Kanagawa (JP)

( * ) Notice: Subject to any disclaimer, the term of this patent is extended or adjusted under 35 U.S.C. 154(b) by 0 days.

(21) Appl. No.: 17/192,311

(22) Filed: Mar. 4, 2021

(65) Prior Publication Data

US 2021/0210021 A1 Jul. 8, 2021

Related U.S. Application Data

(63) Continuation of application No. 16/851,719, filed on Apr. 17, 2020, now Pat. No. 10,971,076.

(30) Foreign Application Priority Data

Apr. 18, 2019 (JP) ..... JP2019-079477

(51) Int. Cl.
*G09G 3/3275* (2016.01)
*G09G 3/325* (2016.01)
*G09G 3/00* (2006.01)

(52) U.S. Cl.
CPC ..... *G09G 3/3275* (2013.01); *G09G 3/325* (2013.01); *G09G 3/006* (2013.01); *G09G 2310/0297* (2013.01)

(58) Field of Classification Search
CPC ... G09G 2310/0297; G09G 2300/0413; G09G 2330/08; G09G 2330/12
USPC ..... 345/204
See application file for complete search history.

(56) References Cited

U.S. PATENT DOCUMENTS

| | | | | |
|---|---|---|---|---|
| 9,129,544 | B2 | 9/2015 | Saitoh et al. | |
| 10,971,076 | B2 * | 4/2021 | Kawachi | G09G 3/3291 |
| 2006/0103410 | A1 * | 5/2006 | Jeon | G09G 3/006 324/760.02 |
| 2010/0214273 | A1 * | 8/2010 | Shirouzu | G09G 3/30 345/205 |

(Continued)

FOREIGN PATENT DOCUMENTS

| | | |
|---|---|---|
| JP | 2003-262884 A | 9/2003 |
| JP | 2009-302183 A | 12/2009 |

*Primary Examiner* — Tom V Sheng
(74) *Attorney, Agent, or Firm* — Sughrue Mion, PLLC

(57) ABSTRACT

A display device includes a pixel circuit on a substrate, a data line configured to transmit a data signal for the pixel circuit on the substrate, and a monitoring circuit. The pixel circuit includes a driving transistor configured to control an amount of electric current supplied to a light-emitting element, and a first switching transistor disposed between the light-emitting element and the driving transistor. The first switching transistor switches between supplying and not supplying the light-emitting element with electric current from the driving transistor. The monitoring circuit monitors a signal at a monitoring point located between the driving transistor and the first switching transistor in the pixel circuit.

2 Claims, 26 Drawing Sheets

(56) References Cited

U.S. PATENT DOCUMENTS

| | | | | |
|---|---|---|---|---|
| 2010/0259527 | A1* | 10/2010 | Odawara | G09G 3/3233 345/211 |
| 2012/0299978 | A1* | 11/2012 | Chaji | G09G 3/006 345/690 |
| 2013/0100173 | A1* | 4/2013 | Chaji | G09G 5/10 345/690 |
| 2013/0271168 | A1 | 10/2013 | Zhuang et al. | |
| 2014/0252988 | A1* | 9/2014 | Azizi | H05B 45/14 315/307 |
| 2014/0267215 | A1* | 9/2014 | Soni | G09G 3/3291 345/212 |
| 2015/0014686 | A1 | 1/2015 | Lv | |
| 2015/0084666 | A1 | 3/2015 | Kim et al. | |
| 2016/0104422 | A1* | 4/2016 | Kishi | G09G 3/006 345/205 |
| 2016/0300534 | A1* | 10/2016 | Kishi | G09G 3/3283 |
| 2017/0076670 | A1* | 3/2017 | Chaji | G09G 3/3233 |
| 2018/0068611 | A1 | 3/2018 | Chaji et al. | |
| 2019/0318692 | A1 | 10/2019 | Jiang et al. | |
| 2020/0243011 | A1* | 7/2020 | Masaoka | G09G 3/3241 |

* cited by examiner

IN NORMAL OPERATION: SW1=On, SW2=Off $\phi=0$ $\overline{\phi}=1$

AFTER ANOMALY IS DETECTED: SW1=Off, SW2=On $\phi=1$ $\overline{\phi}=0$

MONITORING LINE CONTROL CIRCUIT IN DRIVER IC

DISPLAY DEVICE AND METHOD OF CONTROLLING THE SAME

CROSS-REFERENCE TO RELATED APPLICATIONS

This application is a continuation of U.S. patent application Ser. No. 16/851,719 filed on Apr. 17, 2020 which is a non-provisional application claiming priority under 35 U.S.C. § 119(a) to Patent Application No. 2019-79477 filed in Japan on Apr. 18, 2019, the entire content of which is hereby incorporated by reference.

BACKGROUND

This disclosure relates to a display device and a method of controlling the same.

Flat display devices such as liquid crystal display (LCD) devices and organic light-emitting diode (OLED) display devices are used in a large variety of fields. For example, they are used in monitors for computers, television sets for home use, and mobile terminals such as smartphones and tablet computers, and further, even in automobiles and machine tools.

Such expansion of the application field of flat display devices brings flat display devices into severe environments such as a high-temperature environment, a high-humidity environment, and a mechanical vibration environment. For this reason, higher reliability and fault tolerance have been increasingly demanded for the flat display devices.

SUMMARY

An aspect of this disclosure is a display device that includes a pixel circuit on a substrate, a data line configured to transmit a data signal for the pixel circuit on the substrate, and a monitoring circuit. The pixel circuit includes a driving transistor configured to control an amount of electric current supplied to a light-emitting element, and a first switching transistor disposed between the light-emitting element and the driving transistor. The first switching transistor switches between supplying and not supplying the light-emitting element with electric current from the driving transistor. The monitoring circuit monitors a signal at a monitoring point located between the driving transistor and the first switching transistor in the pixel circuit.

It is to be understood that both the foregoing general description and the following detailed description are exemplary and explanatory and are not restrictive of this disclosure.

EMBODIMENTS

Figure 1:
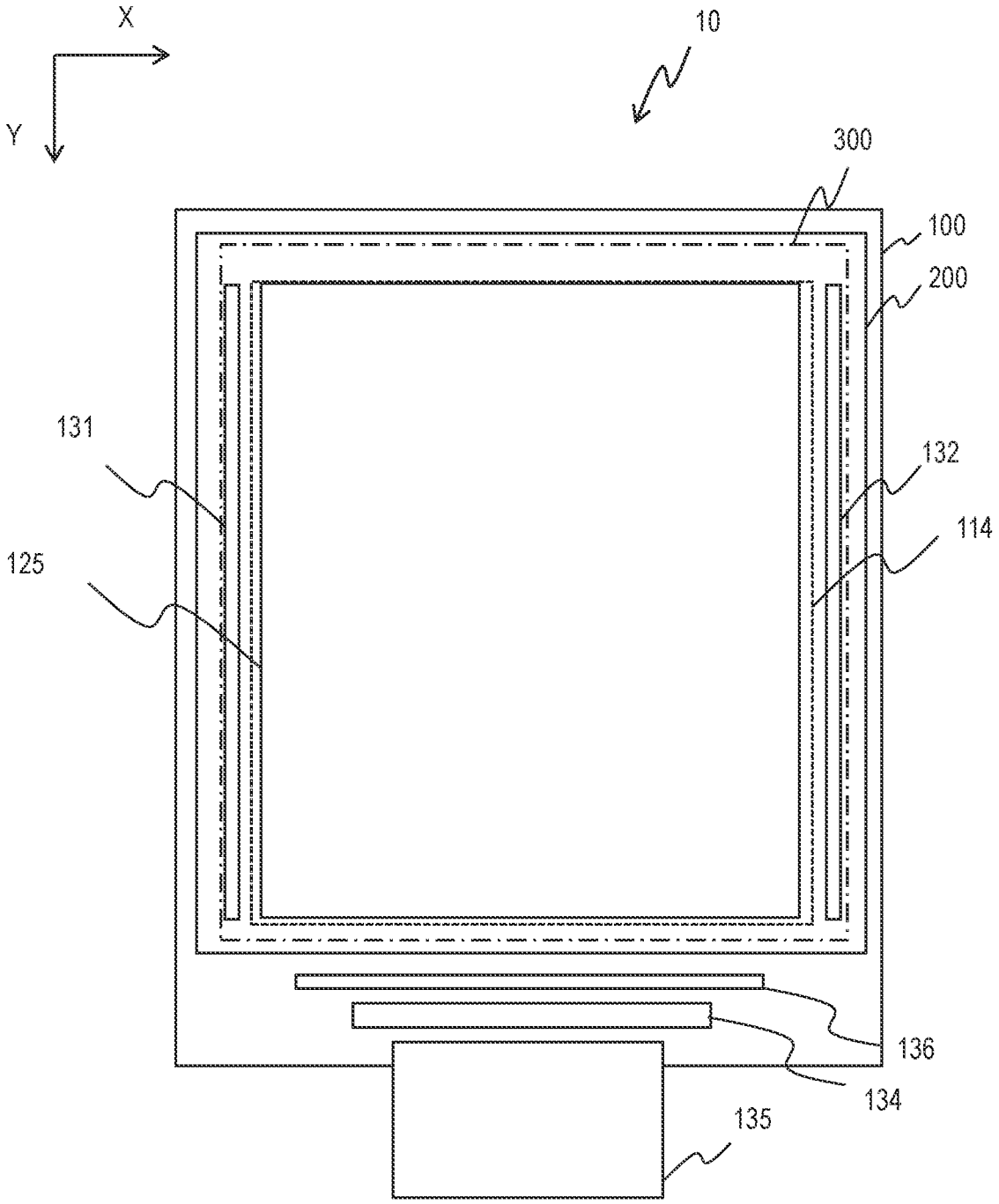
FIG. 1 schematically illustrates a configuration example of an OLED display device.

Hereinafter, embodiments are described specifically with reference to the accompanying drawings. Elements common to the drawings are denoted by the same reference signs and some elements in the drawings are exaggerated in size or shape for clear understanding of description.

Disclosed herein is a technique to increase the reliability and the fault tolerance of a display device such as a liquid crystal display (LCD) device or an organic light-emitting diode (OLED) display device. The technique in this disclosure is suitable for a display device expected to be used in a severe operation environment, like an on-vehicle display device.

A display device like an on-vehicle display device that is used in a severe environment of high temperature, high humidity, and mechanical vibration develops a line defect caused by failure in data signal transmission. Particularly, a line defect caused by connection failure in a COG- or FOG-mounted part is often observed. The bump pitch of a COG data driver is small and the width of each bump is narrow; accordingly, aging of the bumps connecting the data driver (driver IC) and the substrate could cause disconnection that is not found initially.

Particularly in OLED display devices employing various pixel circuit configurations, data signal transmission failure appears as bright defects, not dark defects. Further, in an OLED display device employing a specific pixel circuit configuration, data signal transmission failure appears as a bright line defect that emits light at high luminance. For example, there is a known pixel circuit that applies reset voltage to the gate of the driving thin film transistor (TFT) in a period before detecting a gate threshold voltage Vth. If this pixel is not supplied with a proper data signal after the voltage (which is referenced to the GND) of the gate of the driving TFT is reset, the pixel circuit enters a light emitting period under the reset state. Since the difference between the reset voltage and the power-supply voltage supplied to the source of the driving transistor, namely the gate voltage Vgs, is very large, the light-emitting element emits light at high luminance.

The configuration examples described hereinafter detect data signal transmission failure, and obscure or diminish the display defect caused by data signal transmission failure during operation of the display device. As a result, the fault tolerance of the display panel increases and further, the convenience for the user improves.

Embodiment 1

FIG. 1 schematically illustrates a configuration example of an OLED display device 10 of a display device. The OLED display device 10 includes a thin film transistor (TFT) substrate 100 on which OLED elements (light-emitting elements) are formed, an encapsulation substrate 200 for encapsulating the OLED elements, and a bond (glass frit sealer) 300 for bonding the TFT substrate 100 with the encapsulation substrate 200. The space between the TFT substrate 100 and the encapsulation substrate 200 is filled with an inactive gas such as dry nitrogen and sealed up with the bond 300.

In the periphery of a cathode electrode forming region 114 outer than the display region 125 of the TFT substrate 100, scanning circuits 131 and 132, a driver IC 134, and a demultiplexer 136 are provided. The driver IC 134 is connected to the external devices via flexible printed circuits (FPC) 135. The scanning circuits 131 and 132 drive scanning lines on the TFT substrate 100.

The driver IC 134 is mounted with an anisotropic conductive film (ACF), for example. The driver IC 134 provides power and timing signals (control signals) to the scanning circuits 131 and 132 and further, provides a data signal to the demultiplexer 136.

The demultiplexer 136 outputs output of one pin of the driver IC 134 to d data lines in series (d is an integer more than 1). The demultiplexer 136 changes the output data line for the data signal from the driver IC 134 d times per scanning period to drive d times as many data lines as output pins of the driver IC 134.

The display region 125 includes a plurality of OLED elements (pixels) and a plurality of pixel circuits for controlling light emission of the plurality of pixels. In an example of a color OLED display device, each OLED element emits light in one of the colors of red, blue, and green. The plurality of pixel circuits constitute a pixel circuit array. As will be described later, each pixel circuit includes a driving TFT (driving transistor). The data signal transmitted by a data line determines the gate voltage (Vgs) of the driving TFT. The data signal changes the conductance of the driving TFT in an analog manner to supply a forward bias current corresponding to the light emission level to the OLED element.

Figure 2:
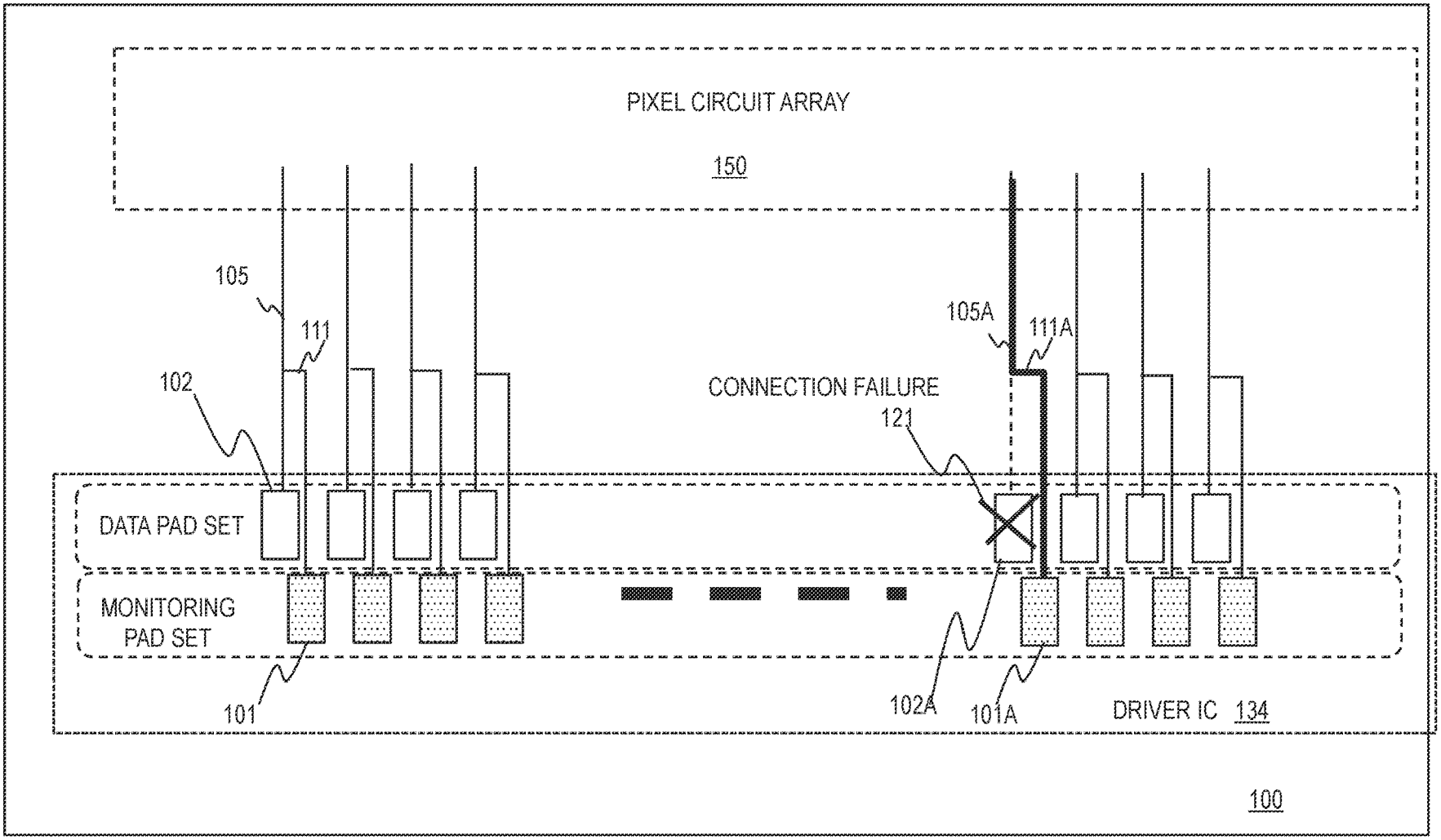
FIG. 2 illustrates an example of a circuit configuration for monitoring and addressing data signal transmission failure in Embodiment 1.

FIG. 2 illustrates an example of a circuit configuration for monitoring and addressing data signal transmission failure in this embodiment. FIG. 2 illustrates an example of connection failure 121 between a bump of the driver IC 134 and a data pad 102 on the TFT substrate 100. The TFT substrate 100 includes a pixel circuit array 150, data lines 105, and data pads 102 formed thereon. The data lines 105 transmit data signals to the pixel circuit array 150. The data pads 102 interconnect the data lines 105 with bumps of the driver IC 134. A plurality of data pads 102 constitute a data pad set.

The TFT substrate 100 further includes monitoring lines 111 and monitoring pads 101 formed thereon. The monitoring pads 101 interconnect the monitoring lines 111 with bumps of the driver IC 134. A plurality of monitoring pads 101 constitute a monitoring pad set. Each monitoring line 111 is disposed not to overlap a data pad 102 and connected with a data line 105 at a specific point (referred to as monitoring point). In FIG. 2, the monitoring point is located at a point between the data pad 102 and the pixel circuit array 150 on the data line 105.

The driver IC 134 sends a data signal to each pixel circuit connected with a data line 105 via a data pad 102 and the data line 105. The driver IC 134 includes a data signal supply circuit (not shown) for generating and supplying the data signal. The driver IC 134 monitors the data signal (data signal voltage) of the data line 105 (and the data pad 102) with a monitoring line 111 (and a monitoring pad 101) associated with the data line 105 by monitoring the voltage of the monitoring line 111 (and the monitoring pad 101).

The driver IC 134 can detect data signal transmission failure from the voltage of the monitoring line 111. Upon detection of data signal transmission failure on some data line 105, the driver IC 134 supplies a correction signal (correction signal voltage) in place of the data signal to the data line 105 through the monitoring line 111 connected with the data line 105. The data line 105 transmits the correction signal to the pixel circuit. The supply of the correction signal prevents occurrence of a display defect.

For example, when connection failure occurs at a data pad 102A, the voltage of the associated data line 105A does not agree with the data signal from the driver IC 134 but becomes constant. The driver IC 134 monitors the voltage of the data line 105A with the monitoring line 111A and the monitoring pad 101A to detect data signal transmission failure caused by the connection failure at the data pad 102A. The driver IC 134 further supplies a correction signal to the data line 105A via the monitoring line 111A and the monitoring pad 101A. The correction signal is supplied to the pixel circuit through the data line 105A.

The driver IC 134 can be configured to notify a not-shown control circuit upon detection of data signal transmission failure. The not-shown control circuit can be configured to issue a visual or auditory alert to request part replacement to the user. As a result, further failure can be prevented.

Figure 3:
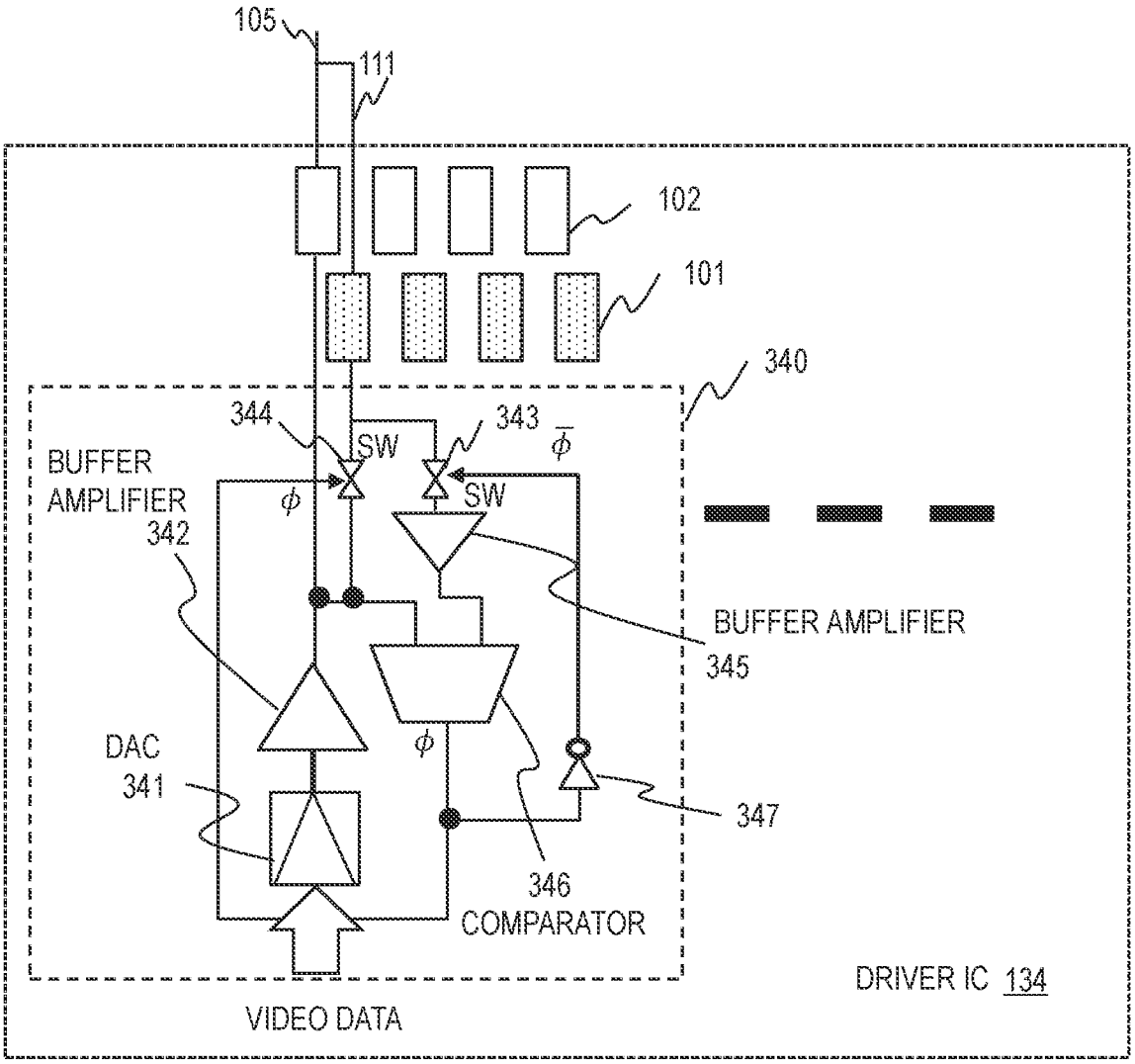
FIG. 3 illustrates a configuration example of internal control of a driver IC for monitoring data signal transmission and addressing failure, if any.

FIG. 3 illustrates a configuration example of internal control of the driver IC 134 for monitoring data signal transmission and addressing failure, if any. FIG. 3 illustrates a monitoring line control circuit 340 for one pair of a data line 105 and a monitoring line 111. The driver IC 134 includes a monitoring circuit including a plurality of monitoring line control circuits 340. In the configuration example of FIG. 3, each monitoring line control circuit 340 is associated with one pair of a data line 105 and a monitoring line 111. The monitoring line control circuit 340 includes a DA converter (DAC) 341, buffer amplifiers 342 and 345, a first switch 343, a second switch 344, a comparator 346, and a NOT gate 347.

When inputs to the comparator 346 are equal, the output φ is 0. When inputs to the comparator 346 are different, the output φ is 1. Each of the switches 343 and 344 is OFF when its input control signal is 0 and is ON when its input control signal is 1. The control signal for the first switch 343 is the inversion signal of the output φ of the comparator 346. On the other hand, the control signal for the second switch 344 is the output φ of the comparator 346.

In normal operation, the DA converter 341 converts digital video data from the external to an analog data signal. The buffer amplifier 342 receives the data signal from the DA converter 341 and outputs it to the data pad 102. The data signal is transmitted by the data line 105 connected with the data pad 102 to the pixel circuit.

In normal operation, the first switch 343 is ON and the second switch 344 is OFF. The data signal (voltage) from the buffer amplifier 342 is input to the comparator 346. Further, the data signal (voltage) of the data line 105 is input to the comparator 346 via the monitoring line 111 and the monitoring pad 101 because the first switch 343 is ON.

Since the values of the two inputs to the comparator 346 are equal (or the data signal voltage), the output φ of the comparator 346 is 0. The output φ of the comparator 346 is inverted by the NOT gate 347 and is input to the first switch 343 as a control signal. Further, the output φ of the comparator 346 is input to the second switch 344 as a control signal.

Next, operation in occurrence of data signal transmission failure is described. When connection failure (connection anomaly) occurs between the data pad 102 and the driver IC 134, the values of two inputs to the comparator 346 become different. One of the inputs to the comparator 346 is the output of the buffer amplifier 342 preceding the data pad 102 and the other one is the voltage of the data line 105. The output of the buffer amplifier 342 varies with the video data and the voltage of the data line 105 is constant.

When the values of the inputs to the comparator 346 are different, the output φ is 1. As a result, the first switch 343 turns from ON to OFF and the second switch 344 turns from OFF to ON. The data signal from the DA converter 341 enters the monitoring pad 101 via the buffer amplifier 342 and the second switch 344. The monitoring line 111 transmits the data signal from the monitoring pad 101 to the data line 105.

As described above, the monitoring line control circuit 340 monitors the voltage of the data line 105 with the monitoring line 111 to detect data signal transmission failure. In response to detection of failure, the monitoring line control circuit 340 supplies the data signal from the DA converter 341 to the data line 105 via the monitoring pad 101 and the monitoring line 111, using the data signal as a correction signal. The data signal is transmitted through the data line 105 to be supplied to the pixel circuit. This configuration enables the data signal to be supplied to the pixel circuit as a correction signal when connection failure occurs at the data pad 102.

Figure 4:
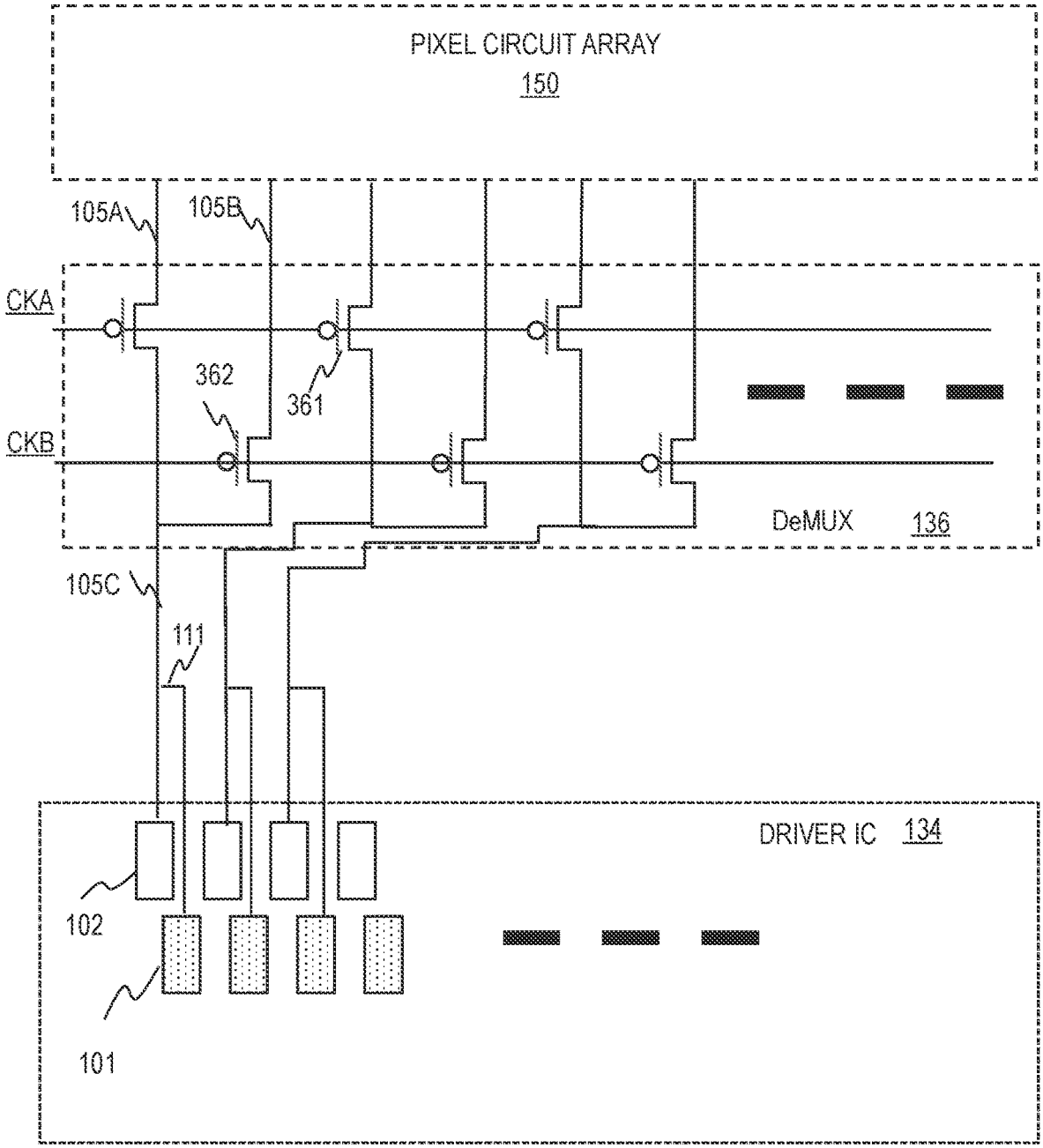
FIG. 4 illustrates a configuration example of a demultiplexer (DeMUX)

FIG. 4 illustrates a configuration example of the demultiplexer (DeMUX) 136. The driver IC 134 in this embodiment has terminals for monitoring data signal transmission, in addition to terminals for outputting data signals. The demultiplexer 136 enables reduction in the number of terminals of the driver IC 134 and the number of pads on the substrate.

The demultiplexer 136 includes switching transistors 361 to be controlled by a clock signal CKA and switching transistors 362 to be controlled by a clock signal CKB. The switching transistors are transistors controlled to be ON or OFF. The clock signals CKA and CKB are supplied by the driver IC 134. Each data pad 102 is connected with one pair of switching transistors 361 and 362.

A switching transistor 361 is connected with a data line 105A connected with the pixel circuit array 150. A switching transistor 362 is connected with a data line 105B connected with the pixel circuit array 150. The data lines 105A and 105B are connected with different pixel circuit sets. A data line 105C connects the switching transistors 361 and 362 to a data pad 102. The data line 105C transmits data signals to be transmitted by both of the data lines 105A and 105B.

The switching transistors 361 and 362 are ON in different periods in accordance with the clock signals CKA and CKB. When the switching transistor 361 is ON, the data signal from the data pad 102 is supplied to a pixel circuit set via the data line 105C, the switching transistor 361, and the data line 105A. When the switching transistor 362 is ON, the data signal from the data pad 102 is supplied to the other pixel circuit set via the data line 105C, the switching transistor 362, and the data line 105B.

The example of FIG. 4 is configured so that one data pad 102 is connected with two data lines for transmitting data signals to different pixel circuit sets; however, one data pad 102 can be connected with three or more signal lines for transmitting data signals to different pixel circuit sets.

Embodiment 2

The configuration example in Embodiment 1 monitors the voltage of a data line at a monitoring point provided between the pixel circuit array and a data pad and supplies a correction signal to a pixel circuit via the data line in response to detection of voltage fault. The configuration example described in the following has a monitoring point within the pixel array, monitors the voltage at the monitoring point with a monitoring line extending in the pixel array, and supplies a correction signal via the monitoring line.

Figure 5:
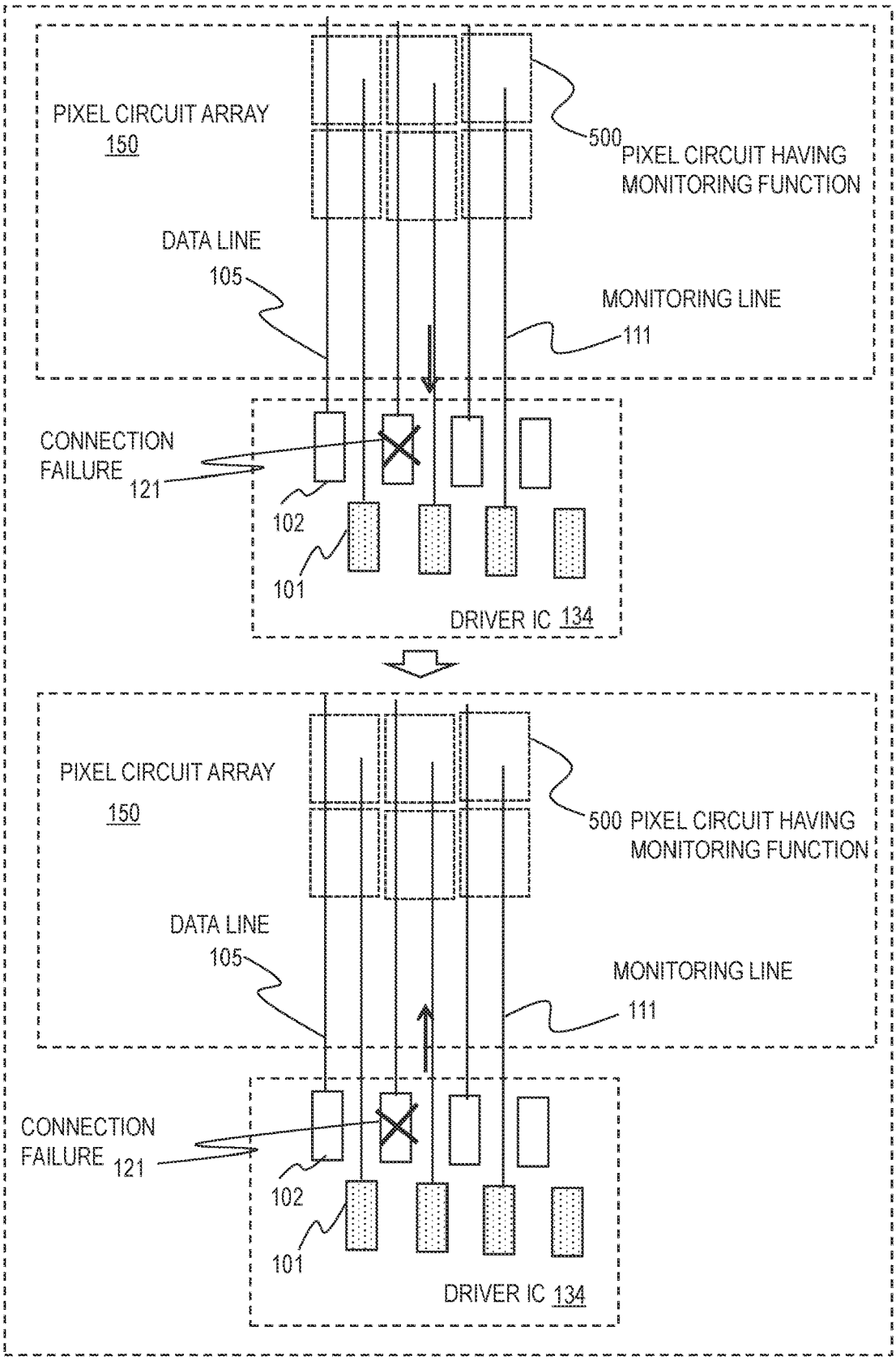
FIG. 5 schematically illustrates the outline of a configuration example in Embodiment 2.

FIG. 5 schematically illustrates the outline of a configuration example in this embodiment. This configuration example includes pixel circuits 500 having a monitoring function and monitoring lines 111 extending in the pixel circuit array 150. The monitoring point of the voltage to be monitored with a monitoring line 111 is located within the pixel circuit array 150. This configuration example monitors the voltage of the monitoring line 111 to defect data signal transmission failure. In FIG. 5, data signal transmission failure caused by connection failure 121 at a data pad 102 is detected through a monitoring line 111. Furthermore, this configuration example supplies a correction signal to pixel circuits 500 via the monitoring line 111 used to detect the failure, in response to detection of the failure.

Figure 6:
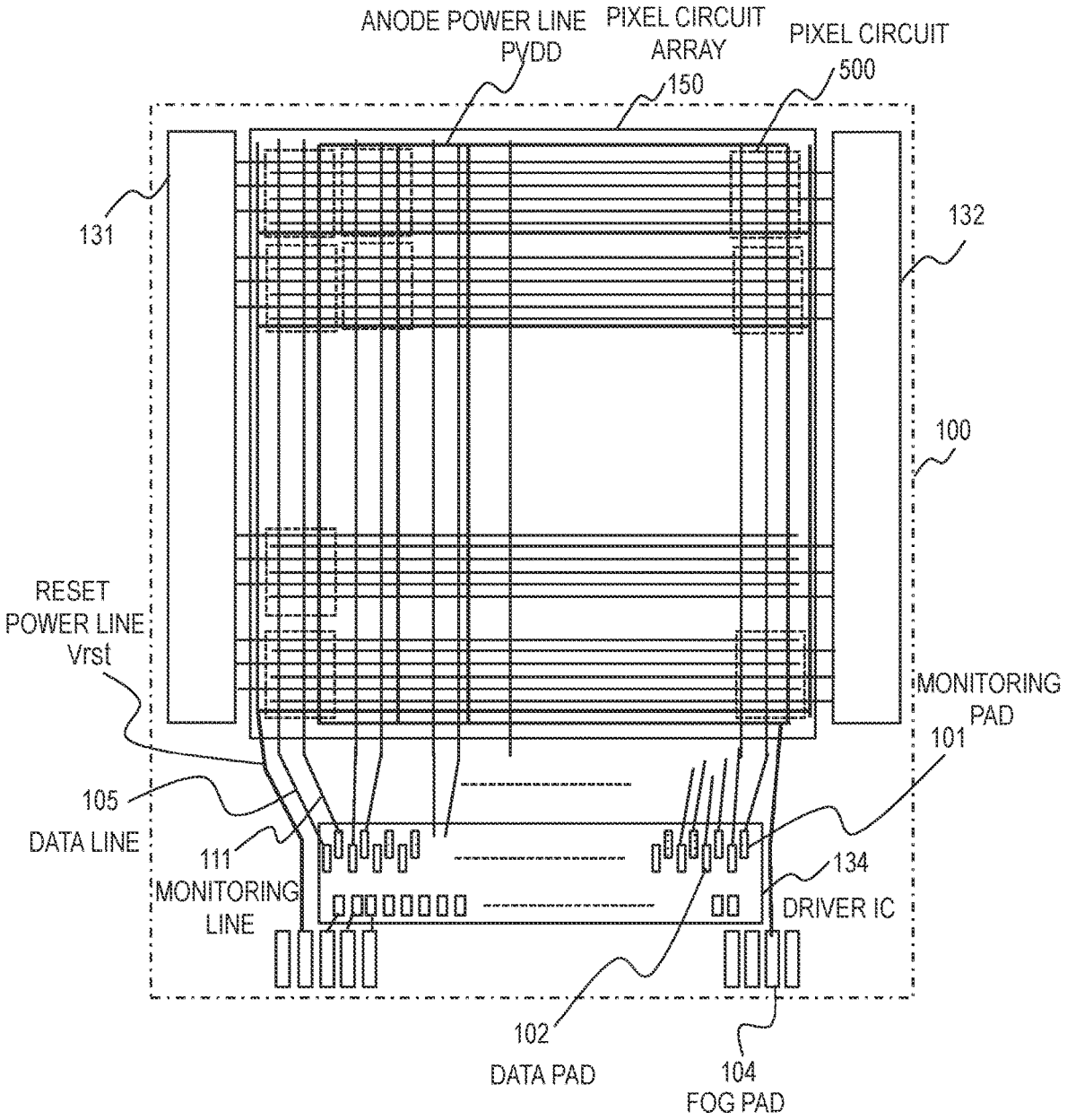
FIG. 6 schematically illustrates a configuration example of a backplane of an OLED display device in Embodiment 2.

FIG. 6 schematically illustrates a configuration example of a backplane of an OLED display device in this embodiment. Pixel circuits 500 disposed in a matrix constitute a pixel circuit array 150. Each pixel circuit 500 controls light emission of an OLED element. In FIG. 6, a set of pixel circuits 500 vertically disposed in a line is referred to a pixel circuit column and a set of pixel circuits 500 horizontally disposed in a line is referred to as a pixel circuit row.

A plurality of data lines 105 and a plurality of monitoring lines 111 from the driver IC 134 extend within the pixel circuit array 150. The data lines 105 and the monitoring lines 111 extend in the column direction. Each pair of a data line 105 and a monitoring line 111 is connected with the pixel circuits in one pixel circuit column.

A plurality of film-on-glass (FOG) pads 104 are provided on a TFT substrate 100. FPC (not shown in FIG. 6) connected with external devices are connected with some FOG pads 104. Some other FOG pads 104 are connected with terminals of the driver IC 134. Control lines from the driver IC 134 to the scanning circuits 131 and 132 are omitted in FIG. 6.

Another FOG pad 104 is connected with an anode power line PVDD. The anode power line PVDD supplies an anode power supply voltage from a not-shown external device to the pixel circuits 500. A plurality of anode power lines PVDD are disposed within the pixel circuit array 150 and they are all connected. In the example of FIG. 6, the plurality of anode power lines PVDD include a plurality of anode power lines PVDD each extending along a pixel circuit column. These anode power lines PVDD supply the power-supply voltage to the anode electrodes of the OLED elements (light-emitting elements).

Another FOG pad 104 is connected with a reset power line Vrst. The reset power line Vrst supplies a reset power supply voltage from a not-shown external device to the pixel circuits 500. A plurality of reset power lines Vrst are disposed within the pixel circuit array 150 and they are all connected.

In the example of FIG. 6, the plurality of reset power lines Vrst include a plurality of reset power lines Vrst each extending along a pixel circuit row. These reset power lines Vrst supply a sufficiently low reset voltage to the anode electrodes of the OLED elements (light-emitting elements) and the gates of the driving transistors.

Figure 7:
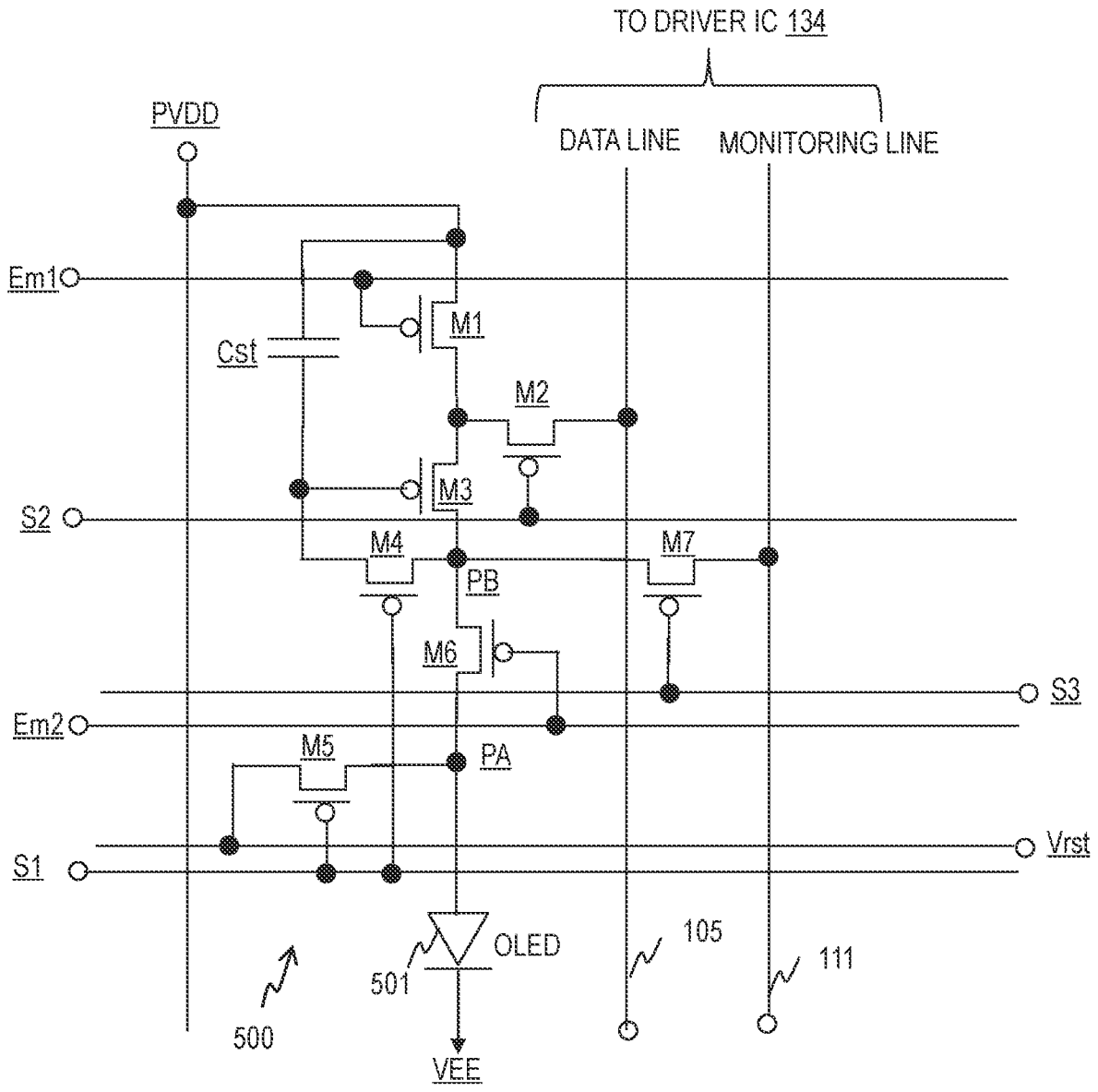
FIG. 7 illustrates a configuration example of a pixel circuit having a monitoring function.

FIG. 7 illustrates a configuration example of a pixel circuit 500 having a monitoring function. The pixel circuit 500 having a monitoring function includes seven transistors (TFTs) M1 to M7. The pixel circuit 500 having a monitoring function controls light emission of an OLED element 501 and further, monitors data signal transmission to the pixel circuit 500 having a monitoring function. The transistors M1 to M7 in this example are of p-type.

The transistor M3 is a driving transistor for controlling the amount of electric current to the OLED element 501. The driving transistor M3 controls the amount of electric current to be supplied from the anode power line PVDD to the OLED element 501 in accordance with the voltage held by the storage capacitor Cst. The cathode of the OLED element 501 is connected with the cathode power line VEE. The storage capacitor Cst holds the voltage between the gate and the source (also referred to simply as gate voltage) of the transistor M3.

The transistors M1 and M6 control whether the OLED element 501 emits light. The transistor M1 switches ON/OFF the supply of electric current from the anode power line PVDD to the driving transistor M3. The transistor (first switching transistor) M6 switches ON/OFF the supply of electric current from the driving transistor M3 to the OLED element 501. The transistor M6 further works to supply the reset voltage to the gate of the driving transistor M3. The transistors M1 and M6 are controlled by light emission control lines Em1 and Em2, respectively, extending from the scanning circuit 131 or 132.

The transistor M5 controls whether to supply the reset voltage to the anode of the OLED element 501 and the gate of the driving transistor M3. When the transistor M5 is turned ON by the selection line S1 extending from the scanning circuit 131 or 132, the transistor M5 supplies reset voltage from the reset power line Vrst to the anode of the OLED 501 and supplies reset voltage to the gate of the driving transistor M3 via the transistors M6 and M4.

The transistor M2 is a selection transistor for selecting the pixel circuit 500 to be supplied with a data signal. The gate voltage of the transistor M2 is controlled by the selection line S2 extending from the scanning circuit 131 or 132. When the selection transistor M2 is ON, the selection transistor M2 supplies the data signal from the data line 105 to the gate of the driving transistor M3 (the storage capacitor Cst).

In this example, the selection transistor M2 (the source and the drain thereof) is connected between the data line 105 and the source of the driving transistor M3. Further, the transistor M4 (the source and the drain thereof) is connected between the drain and the gate of the driving transistor M3.

The transistor (second switching transistor) M4 works to compensate for the variation of the threshold voltage of the driving transistor M3. When the transistor M4 is ON, the driving transistor M3 becomes a diode-connected transistor. The data signal from the data line 105 is supplied to the storage capacitor Cst via the selection transistor M2 that is ON, the driving transistor M3, and the transistor M4. The storage capacitor Cst holds a voltage obtained by adding the threshold voltage Vth of the driving transistor M3 to the data signal. The transistor M4 further works to supply the reset voltage to the gate of the driving transistor M3. The reset voltage is supplied to the gate of the driving transistor M3 in a period the transistors M4, M5, and M6 are ON.

The transistor M7 is a monitoring transistor for monitoring data signal transmission. The gate voltage of the monitoring transistor M7 is controlled by the selection line S3 extending from the scanning circuit 131 or 132. The monitoring transistor M7 is a switching transistor to be turned ON/OFF by the control signal from the selection line S3. The source/drain of the monitoring transistor M7 is connected with the monitoring point PB between the driving transistor M3 and the transistor (first switching transistor) M6 and the remaining source/drain is connected with a monitoring line 111. The driver IC 134 monitors voltage at the monitoring point PB with the monitoring transistor M7 and the monitoring line 111.

Figure 8:
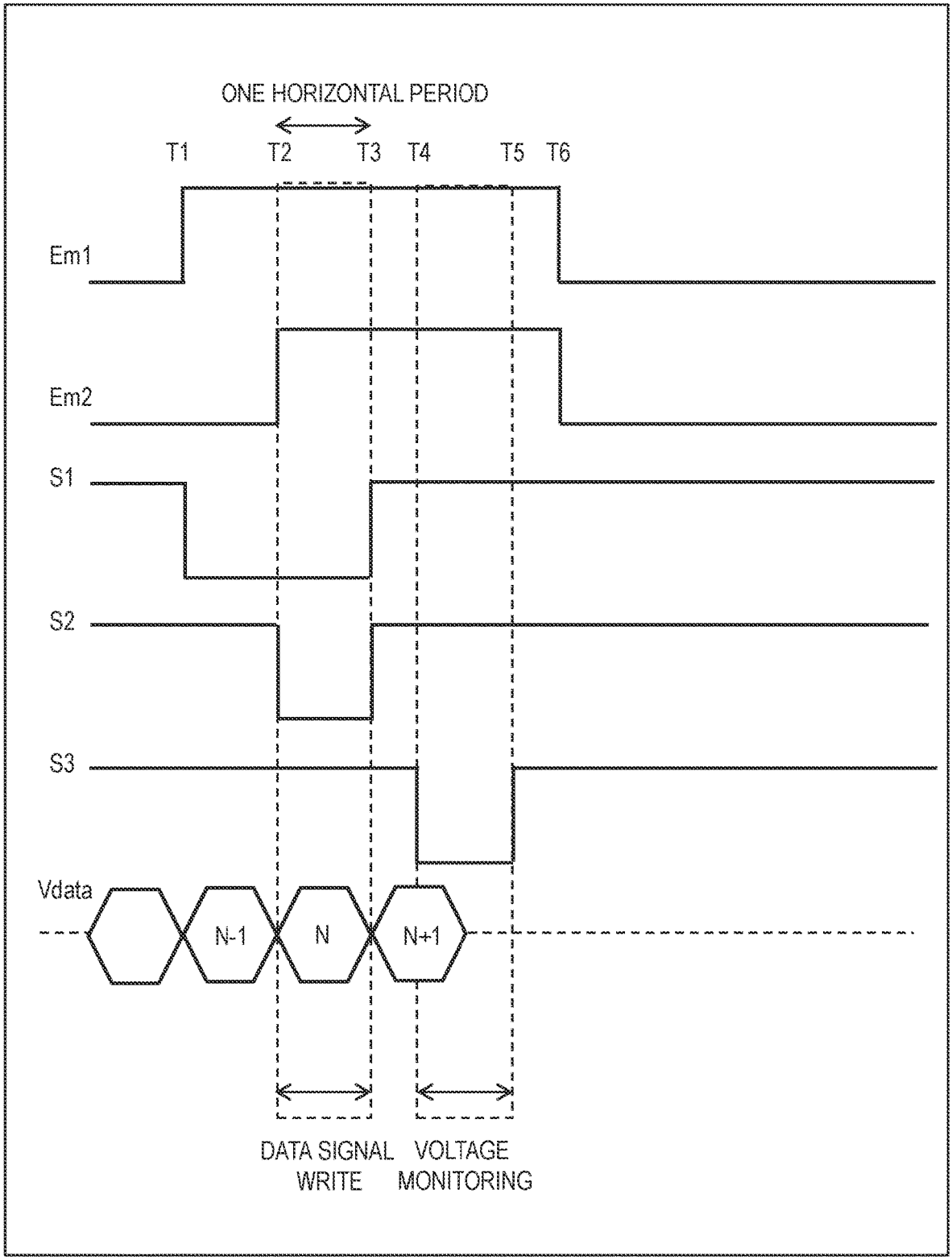
FIG. 8 is a timing chart of signals for controlling (driving) the pixel circuit in FIG. 7 in one frame period.

FIG. 8 is a timing chart of signals for controlling (driving) the pixel circuit 500 shown in FIG. 7 in one frame period. FIG. 8 is a timing chart for selecting the N-th row and writing a data signal Vdata(N) to the pixel circuit 500. In the period from a time T2 to a time T3, the data signal Vdata(N) is written to the storage capacitor Cst in the pixel circuit 500.

At a time T1 prior to the time T2, the light emission control line Em1 is changed from LOW to HIGH and the selection line S1 is changed from HIGH to LOW. The light emission control line Em2 is LOW and the selection lines S2 and S3 are HIGH at the time T1.

In accordance with the above-described control signals, the transistor M1 is OFF and the transistor M6 is ON at the time T1. The transistors M4 and M5 are ON. The transistors M2 and M7 are OFF. These states of the transistors are maintained in the period from the time T1 to the time T2.

In the period from the time T1 to the time T2, the transistors M4, M5, and M6 are ON. The reset voltage of the reset power line Vrst is supplied to the anode of the OLED element 501 via the transistor M5. The reset voltage of the reset power line Vrst is also supplied to the gate of the driving transistor M3 via the transistors M5, M6, and M4.

At the time T2, the light emission control line Em2 is changed from LOW to HIGH and the selection line S2 is changed from HIGH to LOW. The light emission line Em1 is HIGH, the selection line S1 is LOW, and the selection line S3 is HIGH at the time T2. In accordance with these control signals, the transistors M1 and M6 are OFF at the time T2. The transistors M4 and M5 are ON. The selection transistor M2 is ON. The transistor M7 is OFF. These states of the transistors are maintained in the period from the time T2 to the time T3.

In the period from the time T2 to the time T3, the transistor M6 is OFF; the supply of the reset voltage to the gate of the driving transistor M3 is OFF. Since the transistor M4 is ON, the driving transistor M3 is diode-connected. Since the transistor M2 is ON, the data signal Vdata(N) from the data line 105 is transmitted via the transistors M2, M3, and M4 and written to the storage capacitor Cst. The voltage to be written to the storage capacitor Cst is a voltage in which the threshold voltage Vth of the driving transistor M3 compensated for, or the sum of the threshold voltage Vth and the data signal Vdata(N).

In the period from the time T3 to the time T4, all lines are HIGH. At the time T4, the selection line S3 is changed from HIGH to LOW. The other lines are kept at HIGH. In the period from the time T4 to the time T5, the selection line S3 is LOW and the remaining lines are HIGH. Since the selection line S3 is LOW, the transistor M7 is ON.

The voltage at the monitoring point PB on the drain side of the driving transistor M3 is read by the driver IC 134 through the transistor M7 and the monitoring line 111. The period from the time T4 to the time T5 is a monitoring period (measurement period of the voltage) to monitor the data signal transmission to the pixel circuit 500. When the data signal is being transmitted normally, the driver IC 134 reads the voltage corresponding to the data signal Vdata.

At the time T5, the selection line S3 is changed from LOW to HIGH. In the period from the time T5 to the time T6, all lines are HIGH. At the time T6, the light emission control lines Em1 and Em2 are changed from HIGH to LOW to change the transistors M1 and M6 from OFF to ON. Since the other lines are HIGH, the transistors M2, M4, M5, and M7 are maintained to be OFF. The driving transistor M3 controls the driving current to be supplied to the OLED element 501 based on the data signal Vdata(N).

Figure 9:
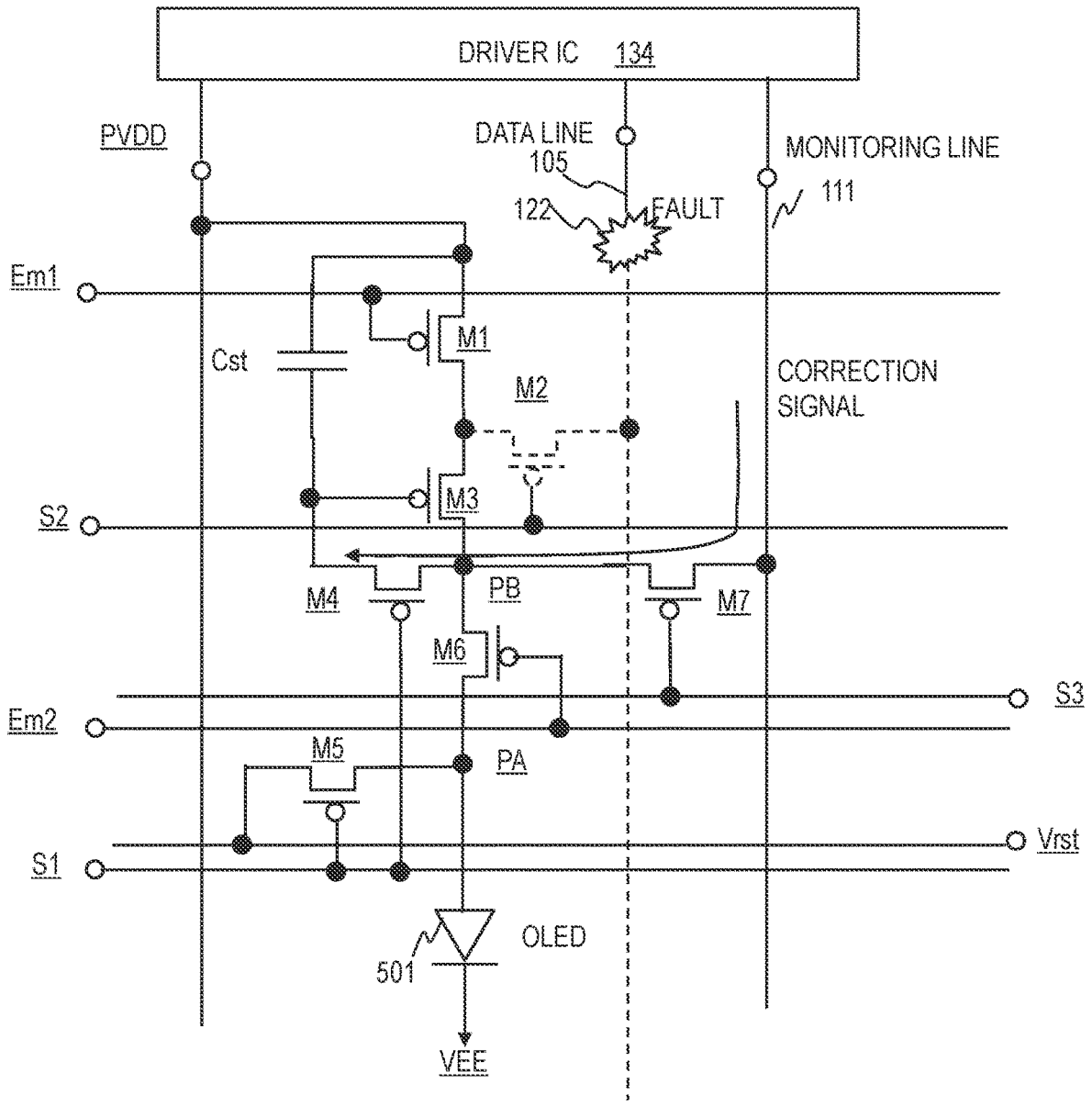
FIG. 9 illustrates an example where data signal transmission failure occurs because of a break (fault) in a data line between the driver IC and a selection transistor.

FIG. 9 illustrates an example where data signal transmission failure occurs because of a break (fault) 122 in the data line between the driver IC 134 and the selection transistor M2. The storage capacitor Cst is not supplied with a data signal. The driver IC 134 monitors (measures) the voltage at the monitoring point PB with the monitoring line 111 in a monitoring period (from the time T4 to the time T5). If the voltage at the monitoring point PB is different from the voltage corresponding to the transmitted data signal, the driver IC 134 supplies a correction signal to the storage capacitor Cst via the monitoring line 111, the transistor M7, and the transistor M4.

The correction signal can be at a value (voltage) determined in accordance with the video data or a predetermined constant value (constant voltage) corresponding to the black level. In supplying the black-level voltage to some pixel circuit, the driver IC 134 can also supply correction signals corresponding to the black level to the pixel circuits for the other colors of pixels associated with the same video data pixel. The correction signal reduces the degradation in display quality caused by data signal transmission failure.

Figure 10:
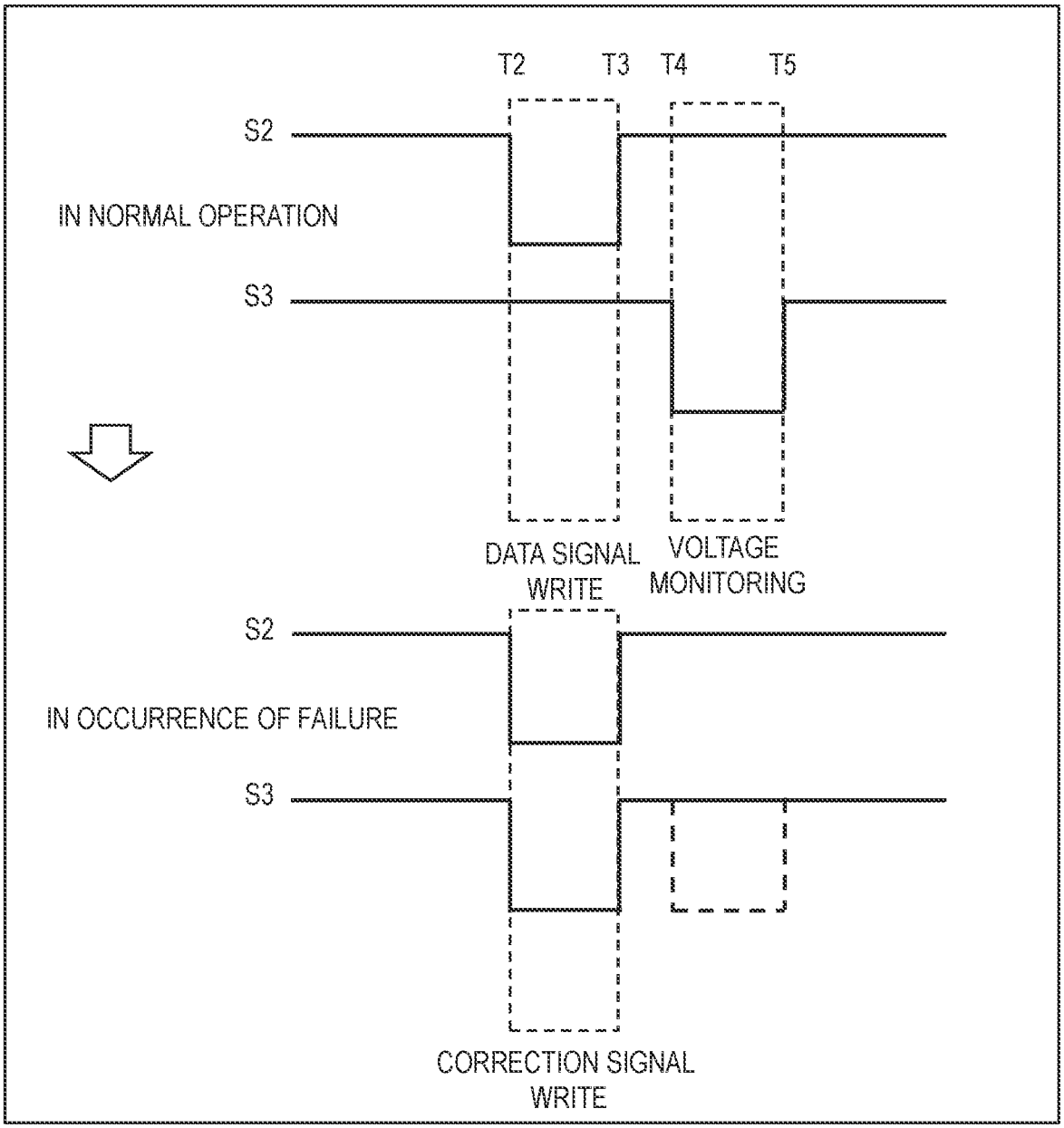
FIG. 10 illustrates signal waveforms of selection lines in one frame period under normal operation and signal waveforms of the selection lines in one frame period after data signal transmission failure is detected.

FIG. 10 illustrates signal waveforms of the selection lines S2 and S3 in one frame period under normal operation and signal waveforms of the selection lines S2 and S3 in one frame period after data signal transmission failure is detected. The signal waveforms of the selection lines S2 and S3 in normal operation are as described with reference to FIG. 8.

As described above, when data signal transmission failure is detected, a correction signal is supplied via the monitoring line 111 and the transistor M7, instead of the data signal supplied via the data line 105. In the example of FIG. 10, the signal waveform of the selection line S3 for controlling the transistor M7 is the same as the signal waveform of the selection line S2 described with reference to FIG. 8. That is to say, the selection line S3 is LOW in the period from the time T4 to the time T5 to make the transistor M7 be ON. The correction signal is supplied to the storage capacitor Cst via the monitoring line 111, the transistor M7, and the transistor M4 in the period from the time T4 to T5.

In the example of FIG. 10, the transistor M7 is connected with a node between the driving transistor M3 and the transistor M6. The transistor M6 is OFF in the period to supply a correction signal. Accordingly, the correction signal from the transistor M7 can be supplied to the storage capacitor Cst (the gate of the driving transistor M3) without being supplied to the OLED element 501. Usually, the period in which a data signal is supplied is shorter than the period from the time T2 to T3 in which the selection line S2 is LOW, for example, in a part of the latter half of the period from the time T2 to the time T3. Accordingly, the selection line S3 can be LOW only in a part of the period from the time T2 to T3.

Figure 11:
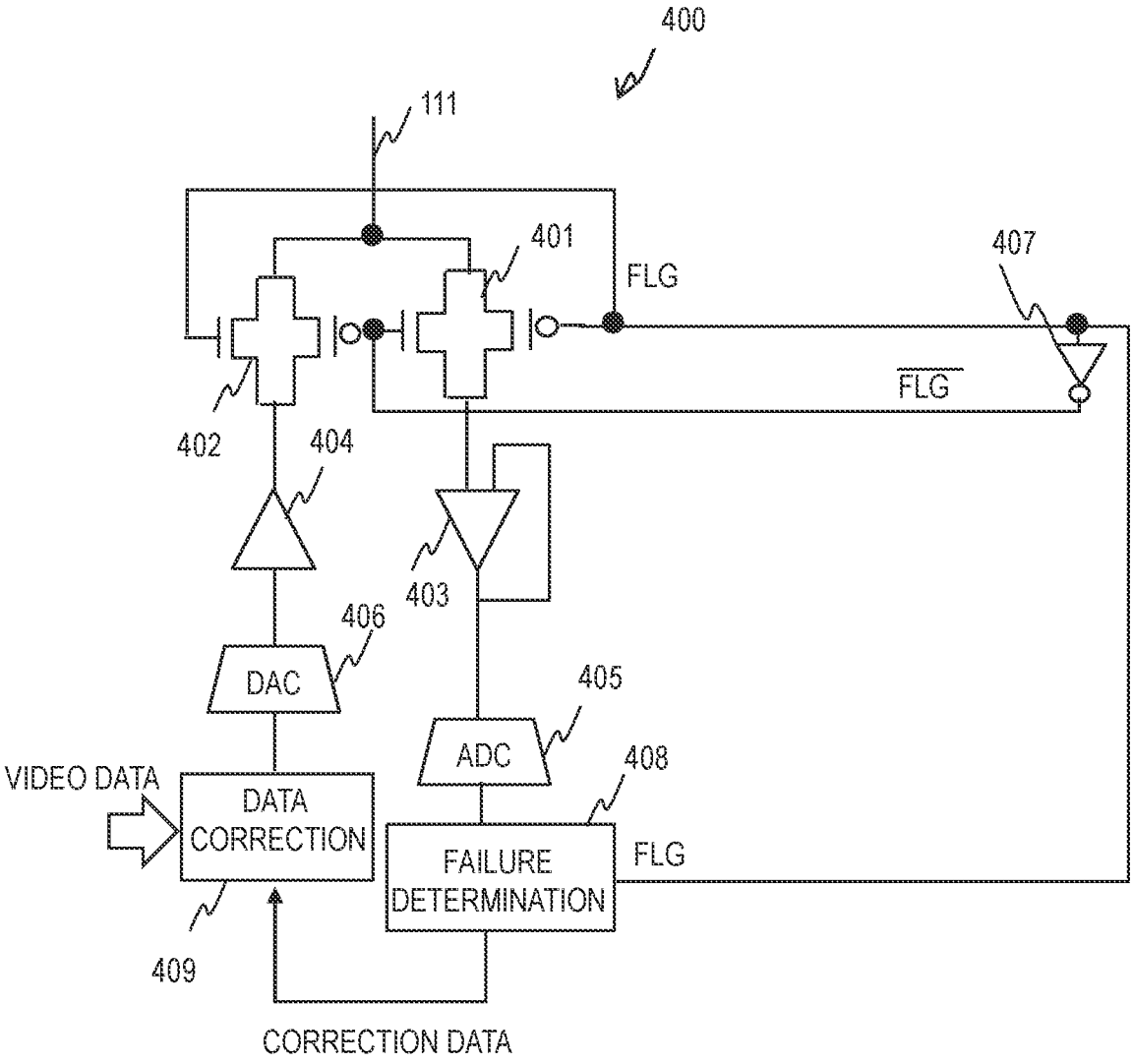
FIG. 11 illustrates a configuration example of a monitoring line control circuit in the driver IC.

FIG. 11 illustrates a configuration example of a monitoring line control circuit 400 in the driver IC 134. Each monitoring pad 101 is provided with one monitoring line control circuit 400; each monitoring line control circuit monitors the voltage through the associated monitoring pad 101 and further, outputs a correction signal. The monitoring line control circuit 400 monitors the voltage of the monitoring line 111 in a monitoring mode and upon detection of data signal transmission failure, it turns to a correcting mode. In the correcting mode, the monitoring line control circuit 400 supplies a correction signal as a replacement of a data signal to the storage capacitor Cst of the pixel circuit 500.

In the mode to monitor the voltage of the monitoring line 111, a flag (signal) FLG output from a failure determination circuit 408 is 0 (LOW). The flag FLG and the flag FLG inverted by the NOT circuit 407 are input to the switches 402 and 401, respectively. Each of the switches 401 and 402 is made of a pair of a p-type transistor and an n-type transistor connected in parallel.

In the monitoring mode, the switch 401 is ON and the switch 402 is OFF. The voltage of the monitoring line 111 is input to the AD converter (ADC) 405 via the switch 401 and the buffer amplifier (sense amplifier) 403. The failure determination circuit 408 determines whether data signal transmission failure occurs based on the output of the ADC 405.

In an example, the failure determination circuit 408 determines whether failure occurs based on whether the output from the ADC 405 changes. If data signal transmission failure occurs, the voltage at the monitoring point is substantially constant. The failure determination circuit 408 determines that data signal transmission failure occurs if the variation in voltage is within a predetermined range for a predetermined number of frame periods.

In another example, the failure determination circuit 408 determines whether failure occurs based on the data signal output to the data line 105 and the output from the ADC 405. In normal operation, the failure determination circuit 408 acquires information on the data signal being supplied and the voltage measured at the monitoring point and identifies the relation between the data signal and the voltage monitored at the monitoring point. The failure determination circuit 408 determines that data signal transmission failure occurs if the difference between the voltage measured at the monitoring point and the value obtained from the data signal being supplied using the above-described relation is larger than a threshold.

The relation between the data signal and the monitored voltage can be preset to the driver IC 134. In relation to the data signal, the monitored voltage varies positively as the scale value (luminance) of the display is increased. When a break occurs, a large amount of current flows, so that a voltage deviated positively and significantly from the voltage monitored at the highest scale value in normal operation is observed. The failure determination circuit 408 detects this deviation.

Upon determination that data signal transmission failure occurs, the failure determination circuit 408 changes the monitoring line control circuit 400 to a correcting mode. The failure determination circuit 408 inverts the flag FLG. The flag FLG changes from 0 (LOW) to 1 (HIGH). The switch 401 turns from ON to OFF and the switch 402 turns from OFF to ON.

A data correction circuit 409 outputs correction data in the data signal write period in the normal operation described with reference to FIGS. 9 and 10. The DAC 406 converts the correction data into an analog correction signal and outputs it to the switch 402 via the buffer amplifier 404. Since the switch 402 is ON, the correction signal is output to the monitoring line 111.

The data correction circuit 409 generates correction data based on video data and correction data from the failure determination circuit 408. As illustrated in FIG. 9, the correction signal is provided to the storage capacitor Cst without passing through the driving transistor M3. Accordingly, the threshold voltage Vth of the driving transistor M3 is not compensated for in supplying the correction signal.

The failure determination circuit 408 determines the threshold voltage, for example using the relation between the monitored voltage and the data signal in a monitoring period, and provides the value to the data correction circuit 409. The data correction circuit 409 adds the threshold voltage to the data signal determined from the video data before outputting. In another example, the driver IC 134 can have a function to measure the threshold voltage of the driving transistor M3. The data correction circuit 409 or the failure determination circuit 408 acquires the threshold voltage measured before the occurrence of failure from this function. The method of measuring the threshold voltage of the driving transistor by controlling the transistors in a pixel circuit is known, explanation thereof is omitted here.

The correction signal can be constant, irrespective of the video data. For example, the correction signal turns OFF the driving transistor M3. This simple control eliminates a bright line defect. In providing a correction signal to turn OFF the driving transistor in some pixel circuit, the driver IC 134 may also provide correction signals to the pixel circuits for the other colors of pixels that correspond to the same video data pixel.

Figure 12:
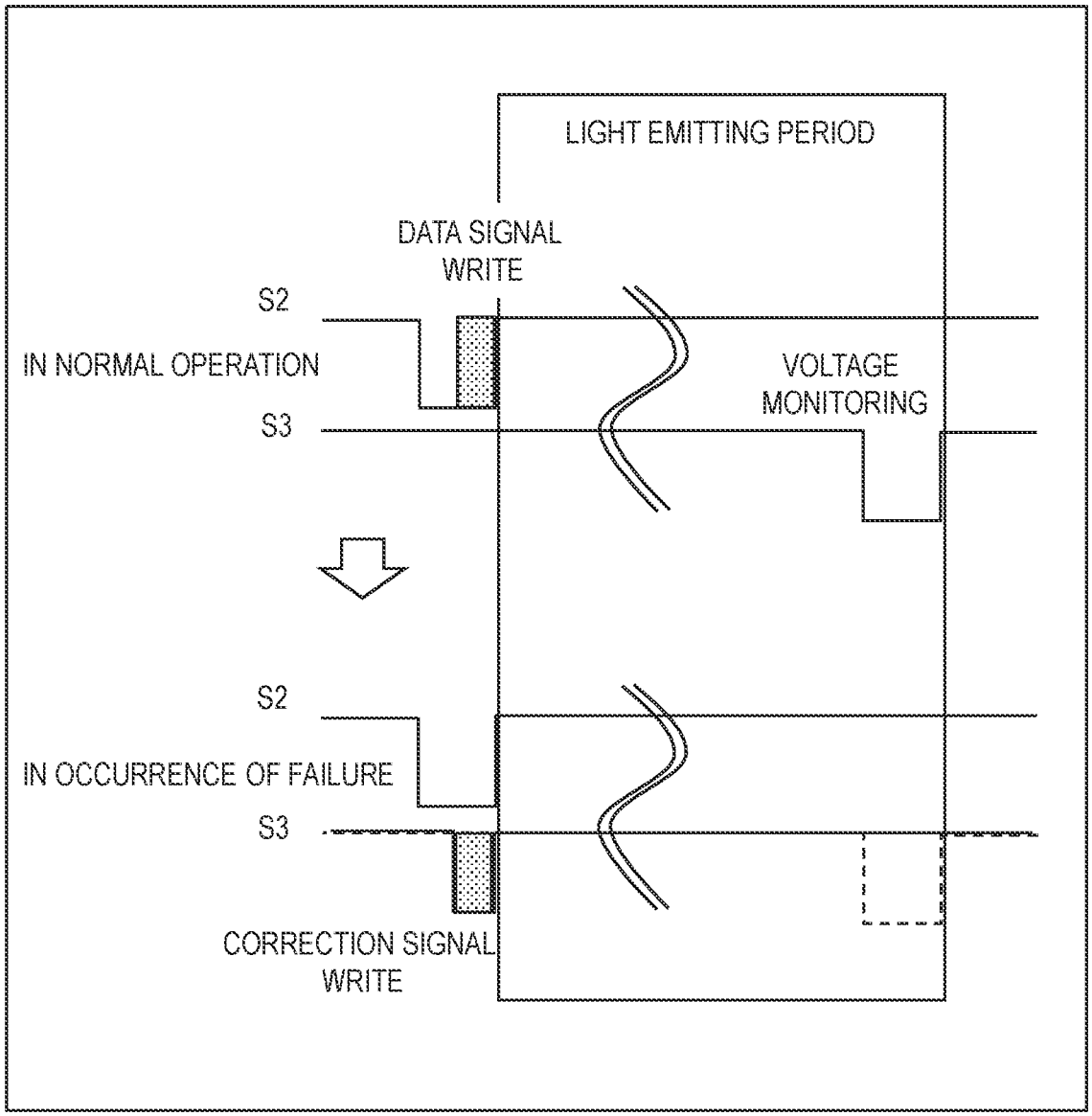
FIG. 12 illustrates another example of a monitoring period.

The above-described example measures the voltage at the monitoring point PB before the OLED element 501 starts emitting light. FIG. 12 illustrates another example of a monitoring period. In this example, the voltage at the monitoring point PB is monitored in the period the OLED element 501 is emitting light. Specifically, the selection line S3 is LOW in a predetermined period between the time T6 to the time T1 of the next frame and is HIGH in the other periods. When the data signal is transmitted normally, the driver IC 134 reads the voltage in accordance with the data signal Vdata.

Upon detection of data signal transmission failure, the driver IC 134 changes the control timing for the selection line S3 so that the transistor M7 will be ON in the data write period in normal operation.

The selection line S3 controls the transistors M7 in the pixel circuits 500 in one row together. For this reason, turning ON a transistor M7 in a data signal write period to supply a correction signal to one pixel circuit 500 (failed pixel circuit) results in turning on all transistors M7 in the other pixel circuits 500 (normal pixel circuits) in the same row. Accordingly, it is important to appropriately control the monitoring line control circuits for the normal pixel circuits (to which a data signal is transmitted normally) when failure occurs.

Figure 13A:
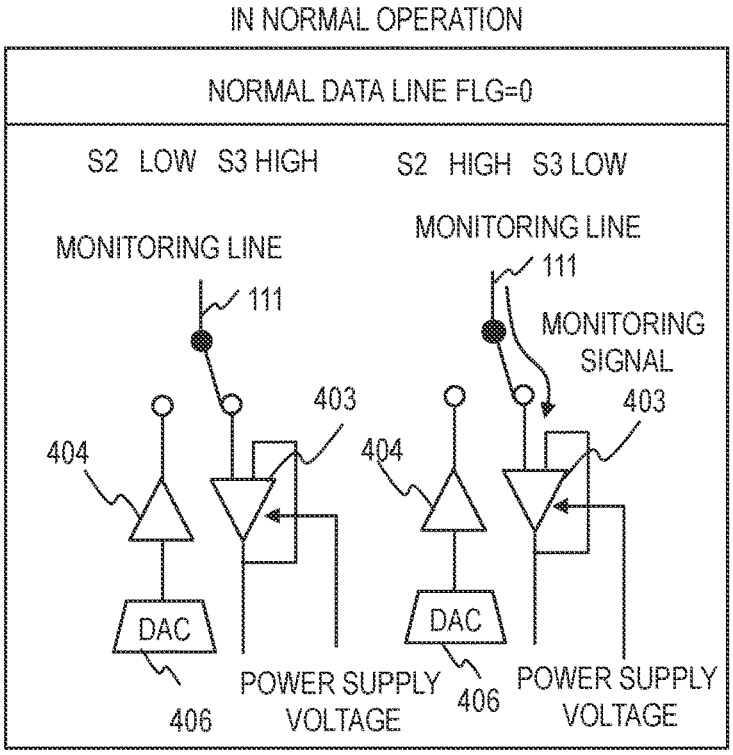
FIG. 13A illustrates operation of a monitoring line control circuit when no failure occurs (in normal operation)

FIG. 13A illustrates operation of a monitoring line control circuit 400 when no failure occurs (in normal operation). The flag FLG from the failure determination circuit 408 is 0. The monitoring line 111 is connected with the sense amplifier 403. In a data signal write period (from the time T2 to the time T3), the selection line S2 is LOW and the selection line S3 is HIGH. The monitoring transistor M7 is OFF; accordingly, there is no signal from the monitoring line 111.

In a voltage monitoring period (measurement period) from the time T4 to the time T5 with the monitoring line 111, the selection line S2 is HIGH and the selection line S3 is LOW. The monitoring transistor M7 is ON; accordingly, the monitoring signal from the monitoring line 111 enters the sense amplifier 403.

Figure 13B:
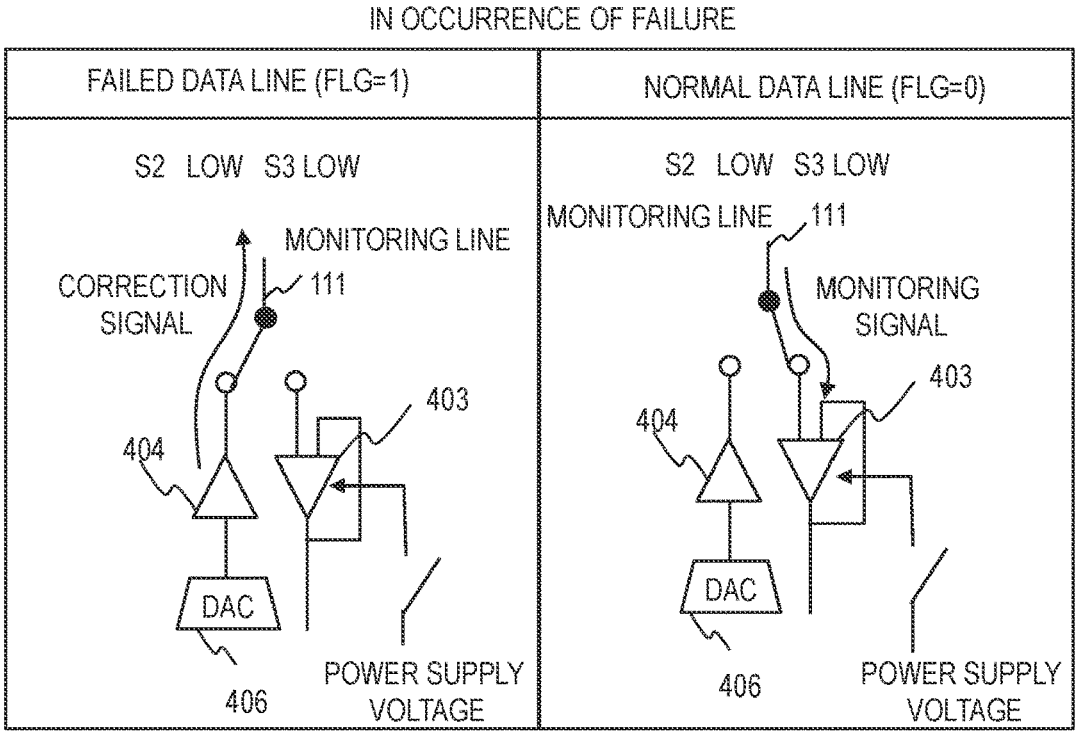
FIG. 13B illustrates operation of a monitoring line control circuit associated with a failed data line and operation of a monitoring line control circuit associated with a normal data line.

FIG. 13B illustrates operation of a monitoring line control circuit 400 associated with a failed data line and operation of a monitoring line control circuit 400 associated with a normal data line 105. FIG. 13B illustrates operation in a period to write a correction signal or a data signal to the storage capacitor Cst. In this period, the selection lines S2 and S3 are LOW and the transistors M2 and M7 are ON. The failed pixel circuit (first pixel circuit) is provided with a correction signal and the normal pixel circuit (second pixel circuit) is provided with a data signal.

In the monitoring line control circuit 400 for the failed data line, the flag FLG is 1. The monitoring line 111 is connected with the output buffer amplifier 404; the correction signal from the DAC 406 is output to the monitoring line (first monitoring line) 111. The correction signal is provided to the storage capacitor Cst via the transistors M7 and M4.

In the monitoring line control circuit 400 for the normal data line (normal pixel circuit), the flag FLG is 0. The monitoring line 111 is connected with the sense amplifier 403. The normal pixel circuit is provided with a data signal through the data line 105. The data signal is supplied to the storage capacitor Cst via the transistors M2, M3, and M4. In the normal pixel circuit, the transistor M7 is ON. Accordingly, the data signal from the data line 105 is input to the sense amplifier 403 via the transistor M7.

The monitoring line control circuit 400 for the normal pixel circuit (second pixel circuit) stops supplying the power-supply voltage to the sense amplifier 403. This brings the monitoring line (second monitoring line) 111 into a high-impedance state, which reduces the effect on the data signal to be supplied to the pixel circuit and further, prevents the sense amplifier 403 from being damaged by the data signal.

Figure 14:
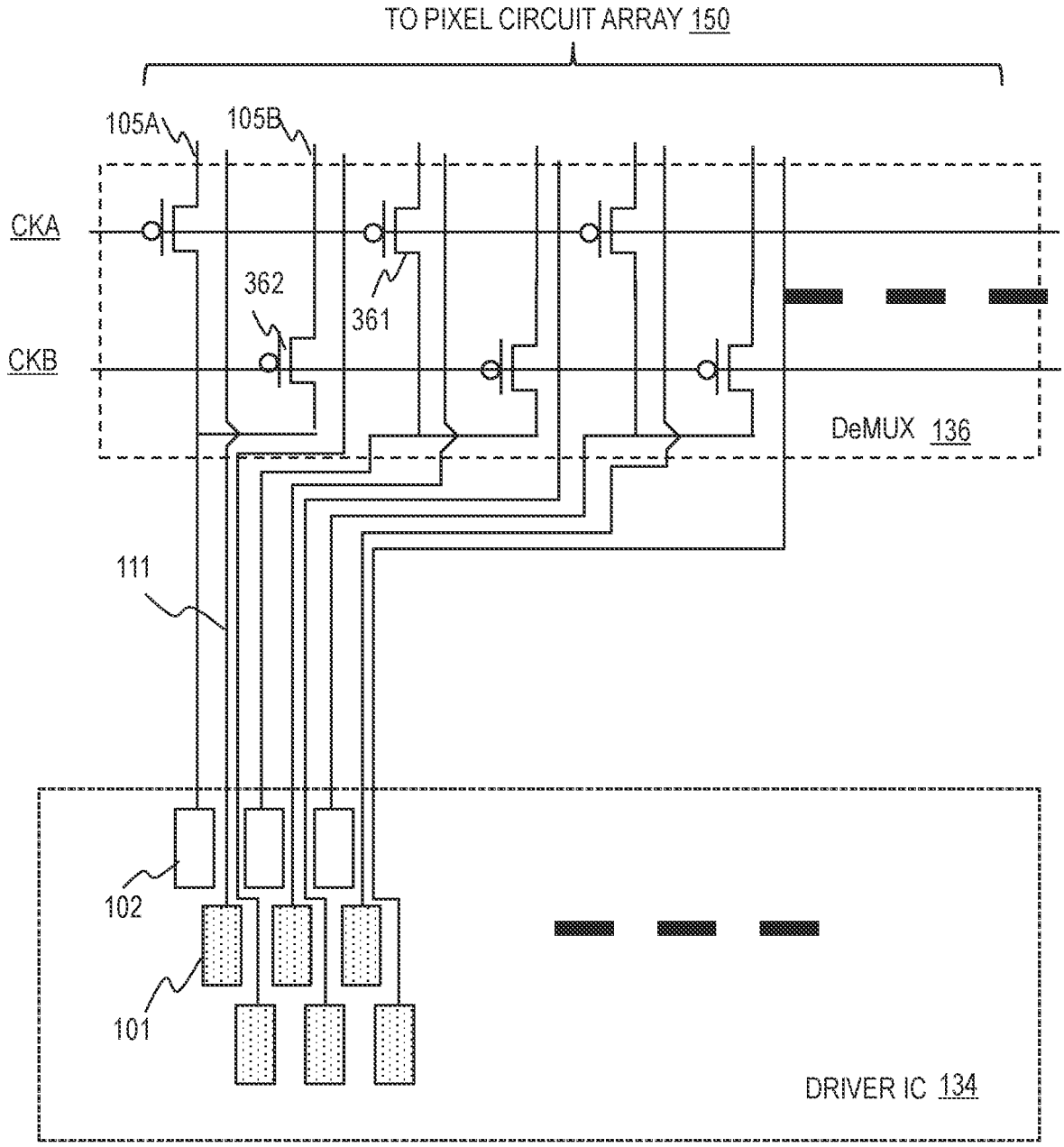
FIG. 14 illustrates a configuration example of a demultiplexer (DeMUX)

FIG. 14 illustrates a configuration example of a demultiplexer (DeMUX) 136. Differences from the configuration example in FIG. 4 in Embodiment 1 are described. Unlike the configuration example in FIG. 4, the monitoring lines 111 extend into the pixel circuit array 150 through the demultiplexer 136. As described above, each monitoring line 111 is connected with the transistor M7 of a pixel circuit 500. The demultiplexer 136 enables reduction in the number of data pads 102.

Embodiment 3

Hereinafter, some configuration examples of a pixel circuit having a monitoring function are described. As will be described in the following, the technique of this disclosure to monitor data signal transmission and correct failure of data signal transmission is applicable to display devices having various pixel circuit configurations.

Figure 15:
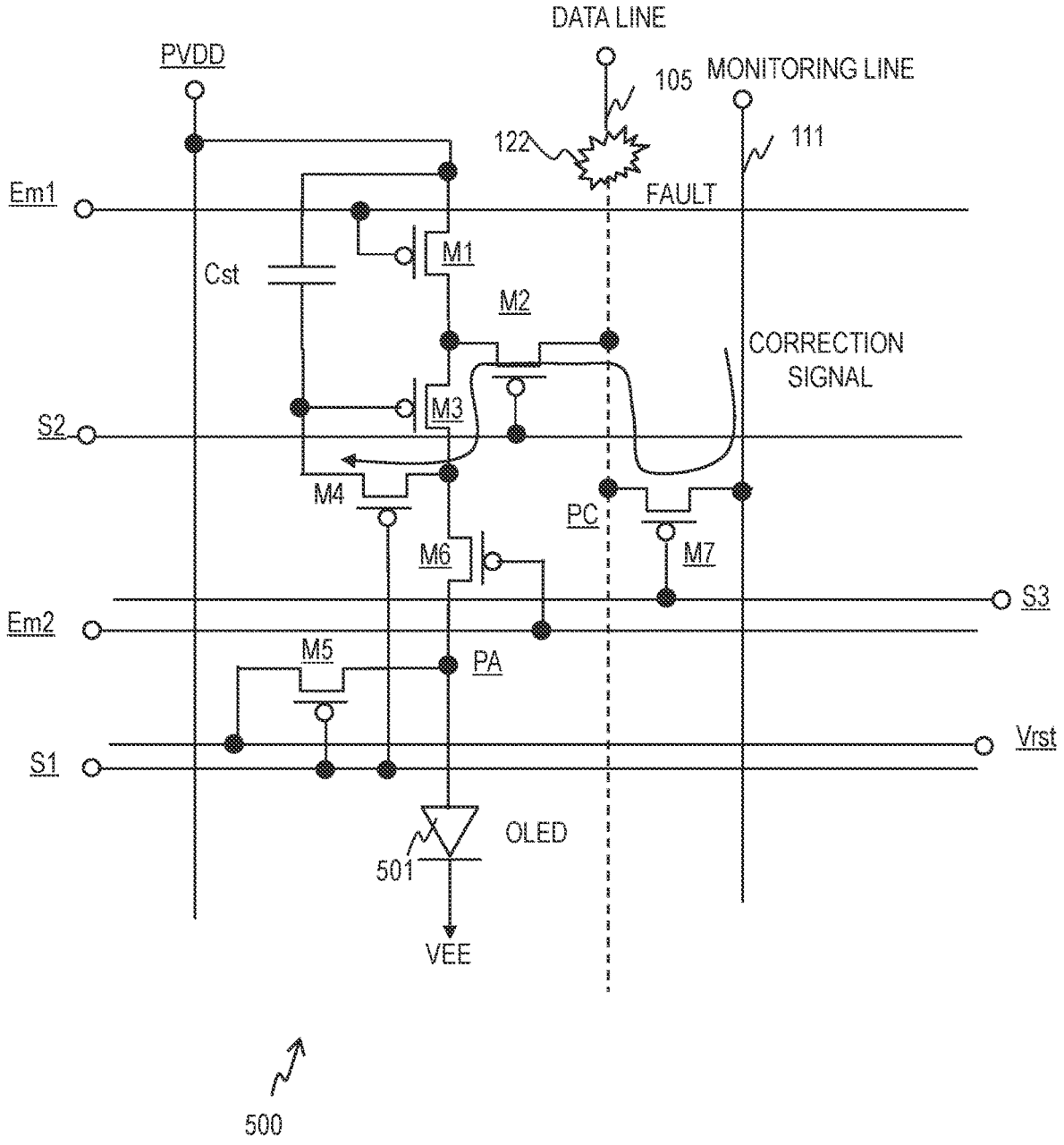
FIG. 15 illustrates a configuration example of a pixel circuit having a monitoring function.

FIG. 15 illustrates a configuration example of a pixel circuit 500 having a monitoring function. Differences from the configuration example illustrated in FIGS. 7 and 9 are mainly described. The source/drain of the monitoring transistor M7 is connected with the data line 105. In other words, the monitoring point PC is located on the data line. The driver IC 134 directly monitors the voltage of the data line to detect data signal transmission failure. In an example, the driver IC 134 monitors (measures) the voltage in the period the data line 105 is transmitting a data signal.

The driver IC 134 supplies a correction signal to the pixel circuit via the data line 105, like the data signal. Since the correction signal is supplied to the storage capacitor Cst (the gate of the driving transistor M3) via the driving transistor M3 and the transistor (second switching transistor) M4, the correction signal can compensate for the threshold voltage.

Figure 16:
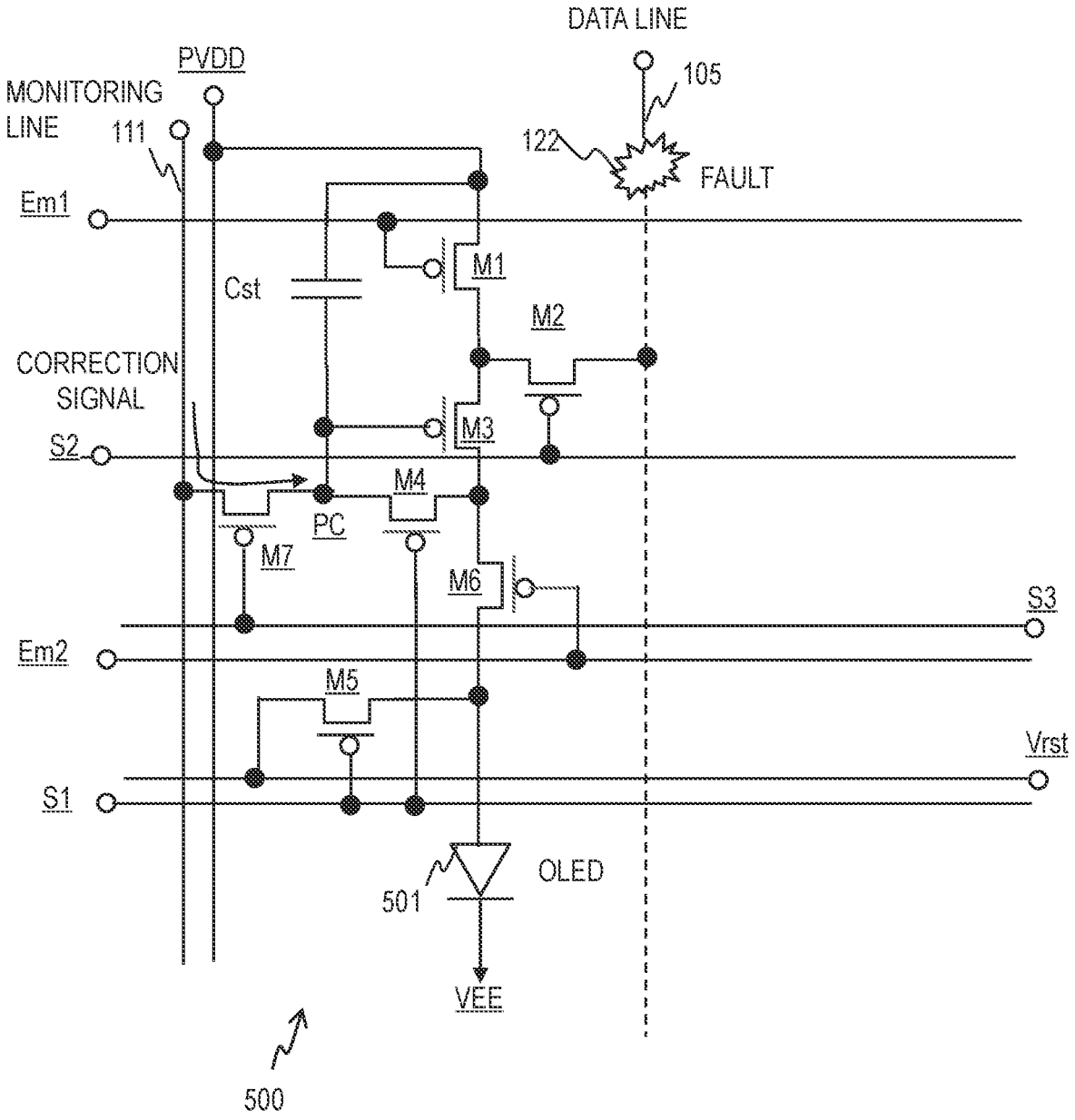
FIG. 16 illustrates another configuration example of a pixel circuit having a monitoring function.

FIG. 16 illustrates another configuration example of a pixel circuit 500 having a monitoring function. Differences from the configuration example illustrated in FIGS. 7 and 9 are mainly described. The source/drain of the monitoring transistor M7 is connected with a node between the transistor M4 and the storage capacitor Cst. In other words, the monitoring point PC is a gate node of the driving transistor M3 and is located between the transistor M4 and the storage capacitor Cst. The driver IC 134 monitors the gate voltage of the driving transistor M3 to detect data signal transmission failure. In an example, the driver IC 134 monitors (measures) the voltage in the light emitting period of the OLED element 501.

The correction signal is supplied to the gate node of the driving transistor M3 (storage capacitor Cst) via the transistor M7. In an example, the driver IC 134 provides a correction signal in which the threshold voltage Vth determined based on the monitored voltage is compensated for or a correction signal of the black level.

Figure 17:
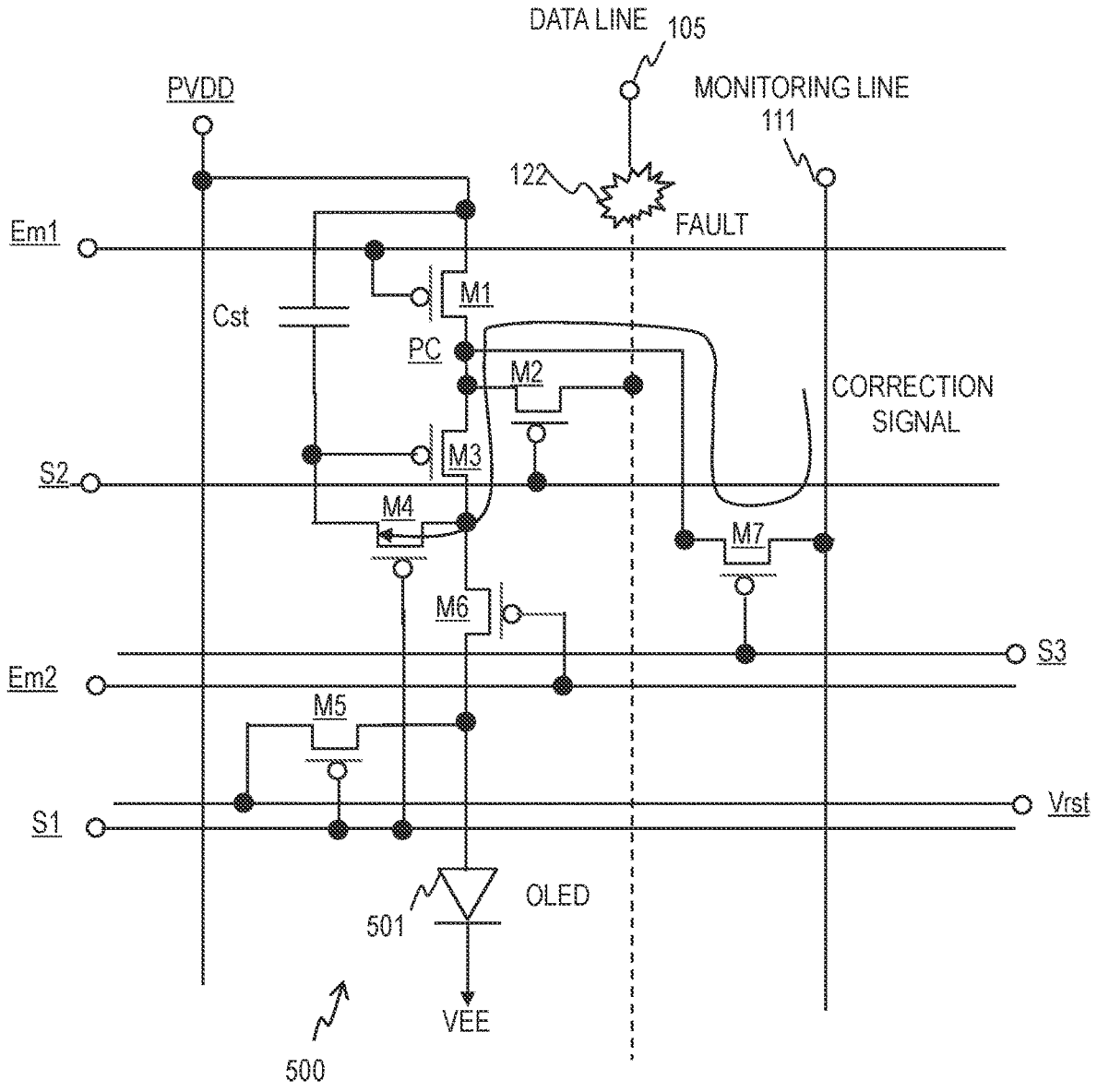
FIG. 17 illustrates still another configuration example of a pixel circuit having a monitoring function.

FIG. 17 illustrates still another configuration example of a pixel circuit 500 having a monitoring function. Differences from the configuration example illustrated in FIGS. 7 and 9 are mainly described. The source/drain of the monitoring transistor M7 is connected with a node between the transistor M1 and the driving transistor M3. In other words, the monitoring point PC is located between the transistor M1 and the driving transistor M3.

The driver IC 134 monitors the voltage at the source/drain of the driving transistor M3 to detect data signal transmission failure. In an example, the driver IC 134 monitors (measures) the voltage in the light emitting period of the OLED element 501. The correction signal is supplied to the storage capacitor Cst (the gate of the driving transistor M3) via the driving transistor M3 and the transistor (second switching transistor) M4, like the data signal. Accordingly, the correction signal compensates for the threshold voltage.

Figure 18:
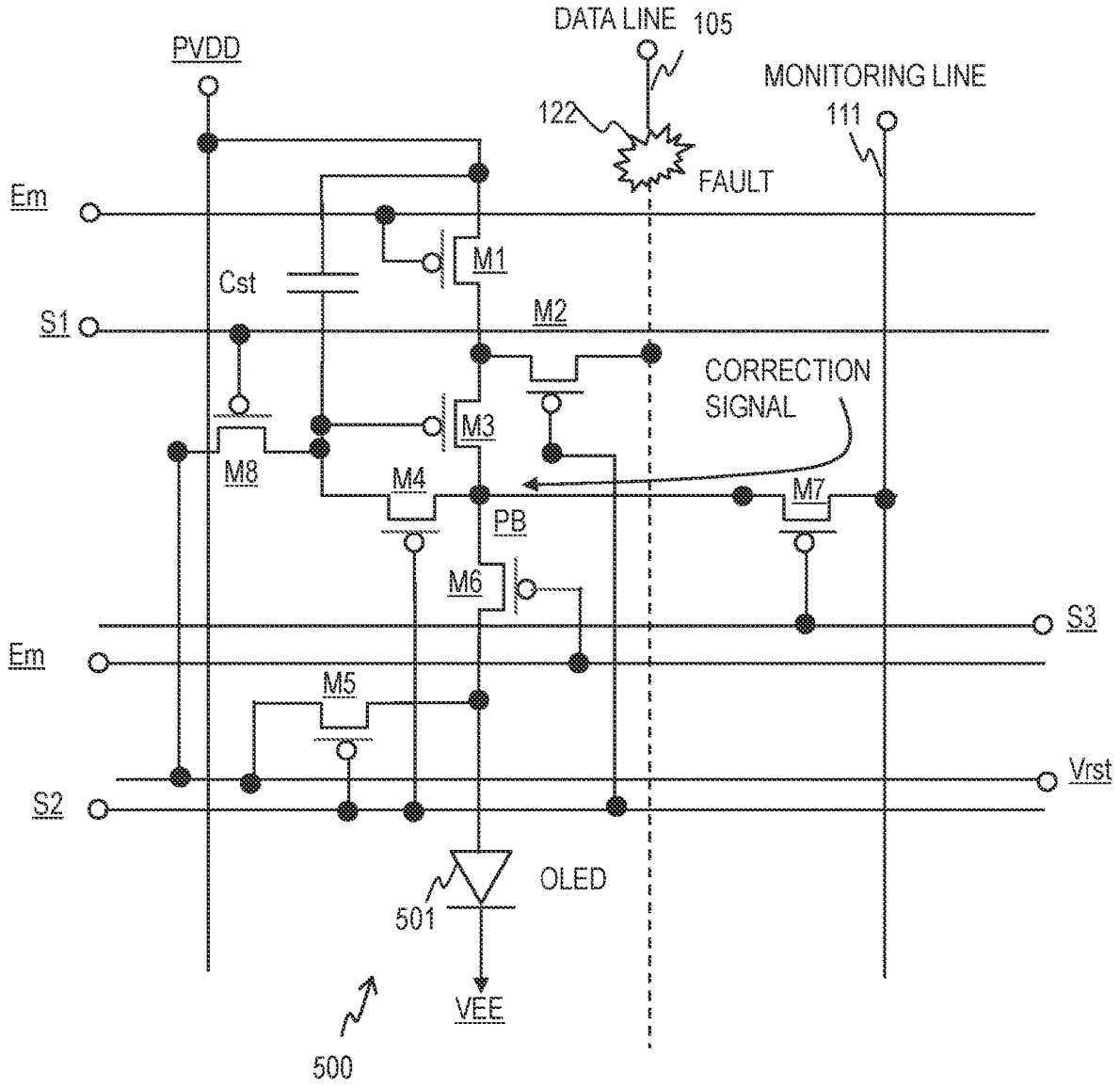
FIG. 18 illustrates still another configuration example of a pixel circuit having a monitoring function.

FIG. 18 illustrates still another configuration example of a pixel circuit 500 having a monitoring function. Differences from the configuration example illustrated in FIGS. 7 and 9 are mainly described. Another transistor M8 is added. The gate of the transistor M8 is connected with the selection line S1; the source/drain is connected with the reset power line Vrst; and the remaining source/drain is connected with a node between the storage capacitor Cst and the transistor M4. The gates of the transistors M4 and M5 are connected with the selection line S2. The voltage monitoring and the correction signal supply using the monitoring transistor M7 are the same as those in Embodiment 2.

Figure 19:
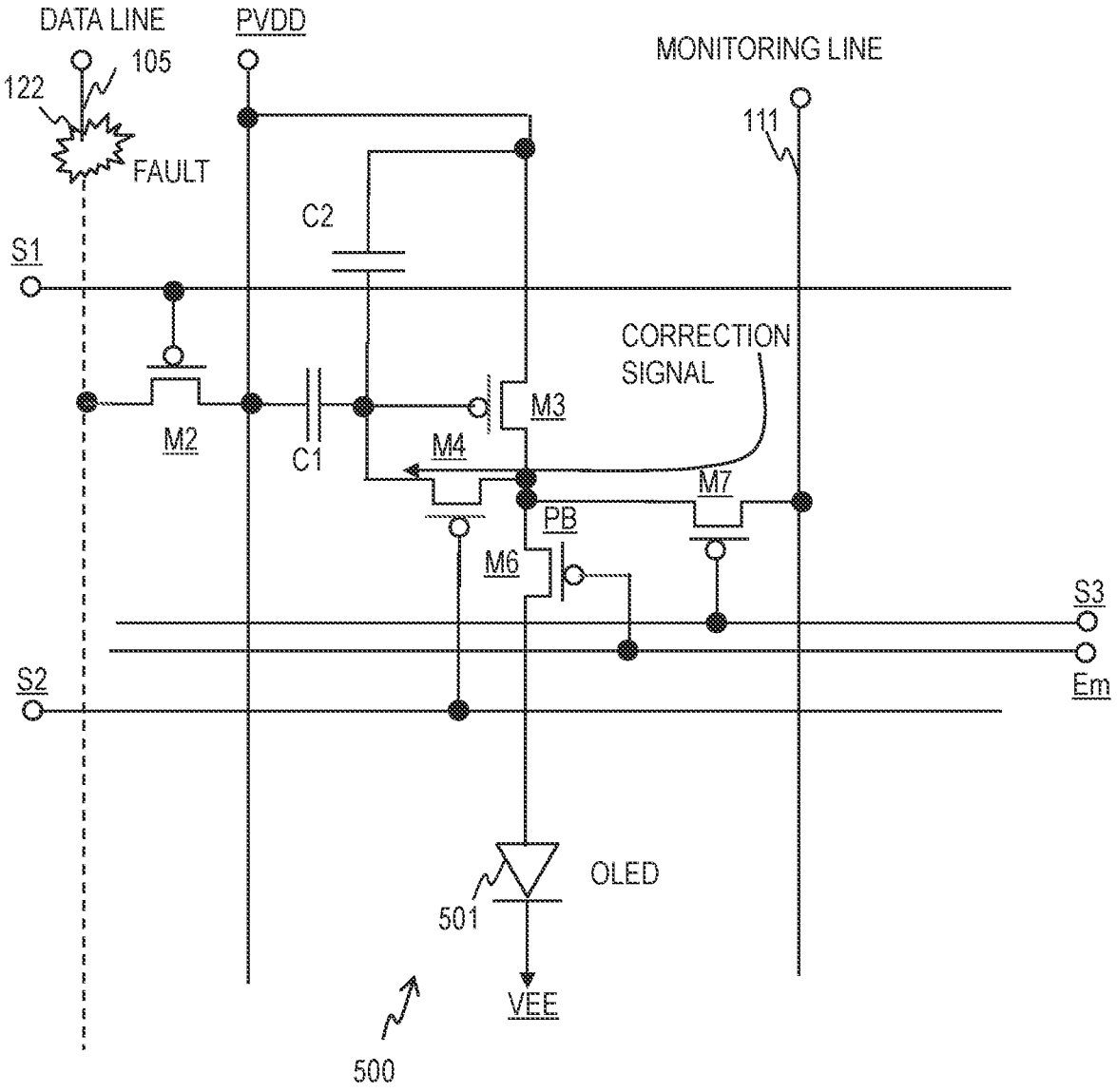
FIG. 19 illustrates still another configuration example of a pixel circuit having a monitoring function.

FIG. 19 illustrates still another configuration example of a pixel circuit 500 having a monitoring function. The transistor M2 supplies the data signal from the data line 105 to the gate of the driving transistor M3 via a coupling capacitor C1. The transistor M2 is turned ON/OFF by the selection line S1. The voltage at the gate of the driving transistor M3 is determined by two capacitors C1 and C2, the data signal, and the threshold voltage Vth of the driving transistor M3. The capacitors C1 and C2 constitute a storage capacitor.

The transistor M6 between the driving transistor M3 and the OLED element 501 controls light emission of the OLED element 501. The transistor M6 is turned ON/OFF by the light emission control line Em. The transistor M4 works to compensate for the threshold voltage Vth of the driving transistor M3. The transistor M4 is turned ON/OFF by the selection line S2. When the transistor M4 is ON, the driving transistor M3 is diode-connected.

The monitoring transistor M7 is turned ON/OFF by the selection line S3. The source/drain of the monitoring transistor M7 is connected with the monitoring line 111 and the remaining source/drain is connected with a node between the driving transistor M3 and the transistor M6. The monitoring point PB is located between the driving transistor M3 and the transistor M6. In an example, the driver IC 134 monitors (measures) the anode voltage of the OLED element 501 in the light emitting period.

The correction signal is provided to the gate of the driving transistor M3 via the transistors M7 and M4. Since the threshold voltage Vth is not automatically compensated for, the monitoring line control circuit in the driver IC 134 can be configured to generate a correction signal in which the threshold voltage Vth is compensated for or a correction signal of the black level, as described in Embodiment 2.

Figure 20:
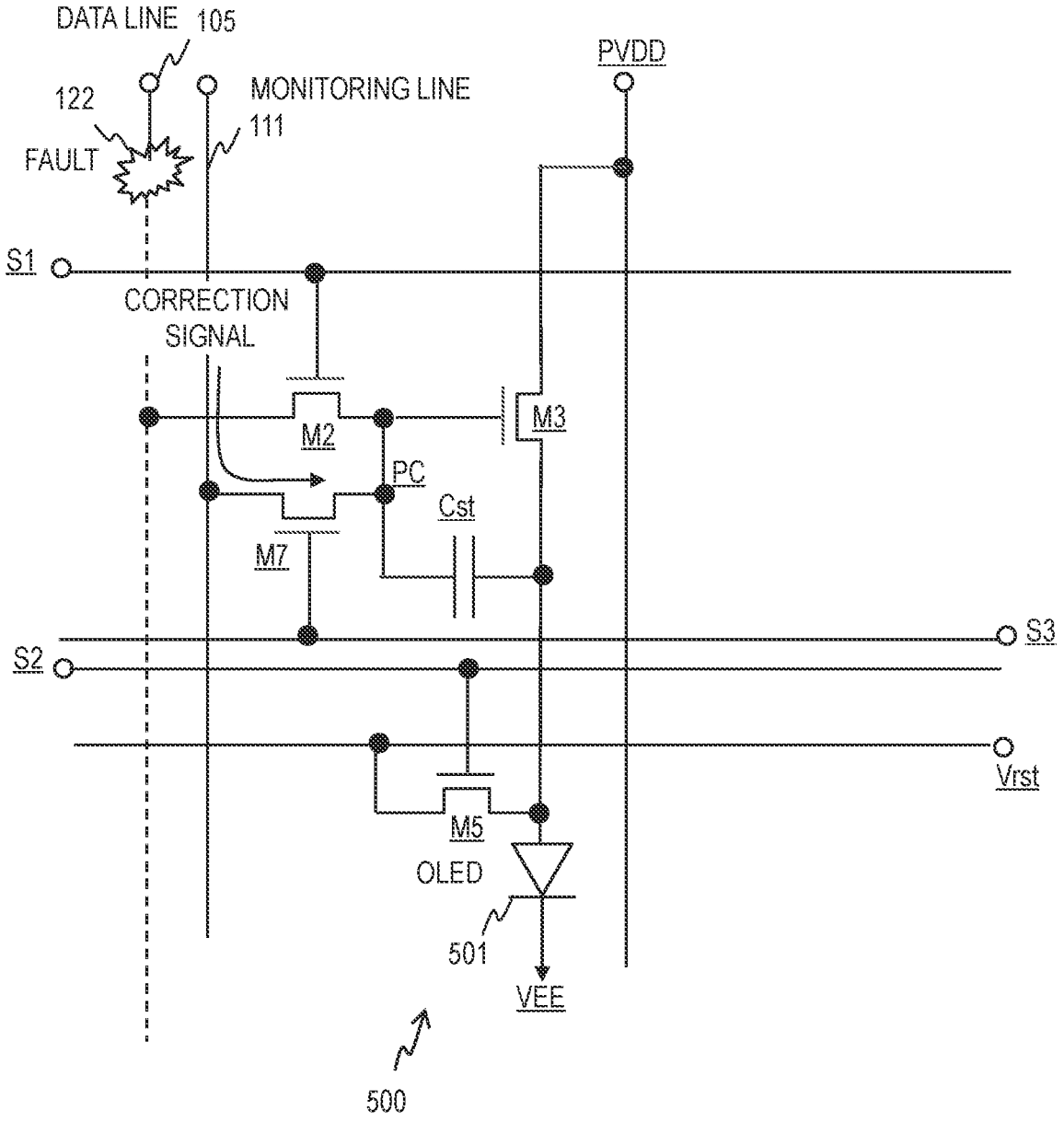
FIG. 20 illustrates still another configuration example of a pixel circuit having a monitoring function.

FIG. 20 illustrates still another configuration example of a pixel circuit 500 having a monitoring function. The transistors (TFTs) in this circuit are of n-type. The transistor M2 supplies the data signal from the data line 105 to the storage capacitor Cst (the gate of the driving transistor M3). The transistor M2 is turned ON/OFF by the selection line S1.

The transistor M5 connects the anode of the OLED element 501 and the reset power line Vrst. The transistor M5 is turned ON/OFF by the selection line S2. The transistor M5 supplies reset voltage to the anode of the OLED element 501 to reset the voltage at the anode before the OLED element 501 emits light.

The monitoring transistor M7 is turned ON/OFF by the selection line S3. The source/drain of the monitoring transistor M7 is connected with the monitoring line 111 and the remaining source/drain is connected with the gate of the driving transistor M3. The monitoring point PC is a gate node of the driving transistor M3 located between the gate of the driving transistor M3 and the storage capacitor Cst. In an example, the driver IC 134 monitors (measures) the voltage at the gate of the driving transistor M3 in the light emitting period. The correction signal is supplied to the gate node of the driving transistor M3 via the transistor M7.

Figure 21:
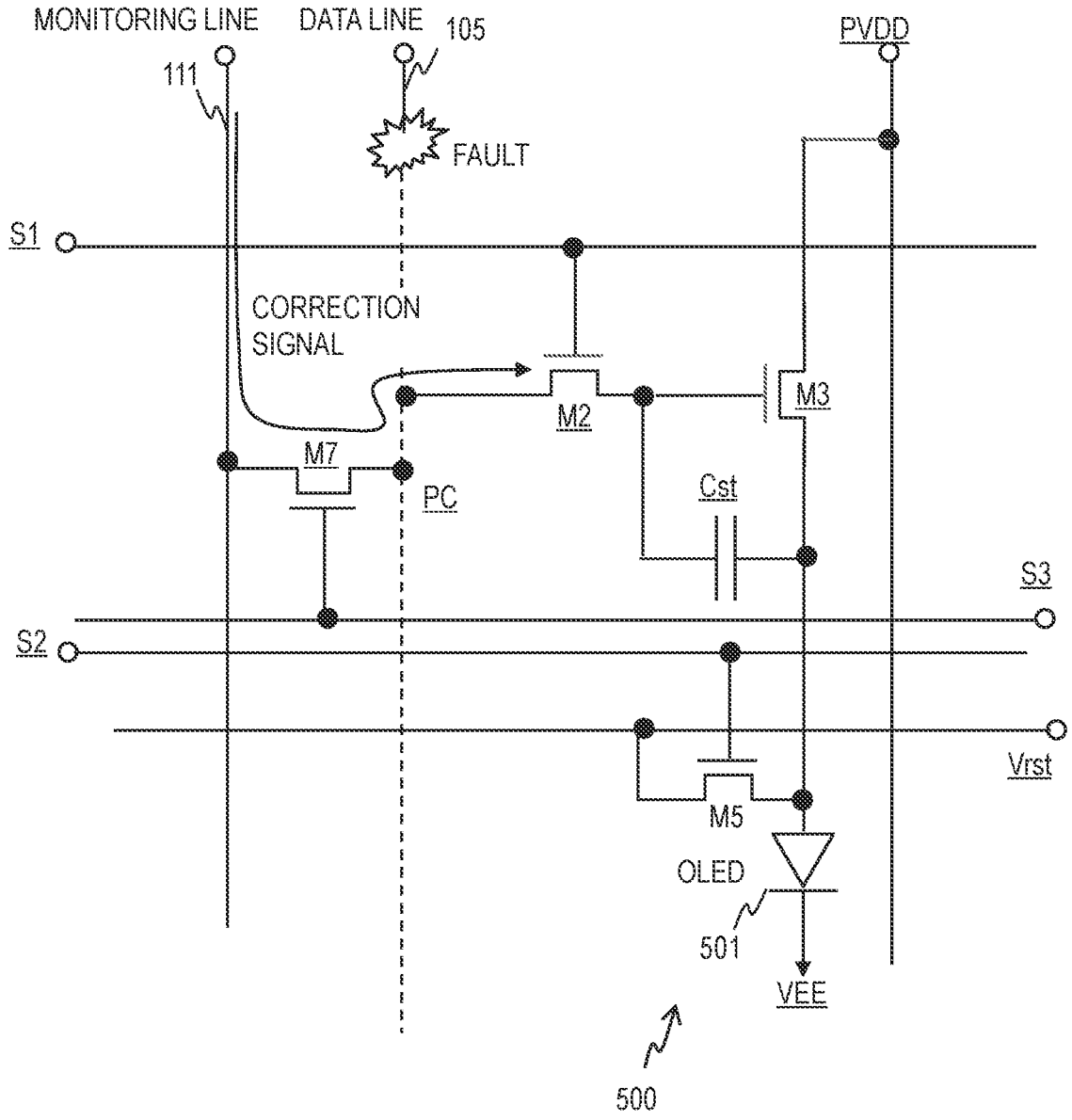
FIG. 21 illustrates still another configuration example of a pixel circuit having a monitoring function.

FIG. 21 illustrates still another configuration example of a pixel circuit 500 having a monitoring function. Compared to the configuration example in FIG. 20, the location of a connection node of the monitoring transistor M7 is different. The monitoring transistor M7 connects the monitoring line 111 and the data line 105. The monitoring point PC is located on the data line 105. The driver IC 134 measures the voltage of the data line 105 in the data write period to detect failure. The correction data is supplied to the gate of the driving transistor M3 via the monitoring line 111 and the data line 105.

Figure 22:
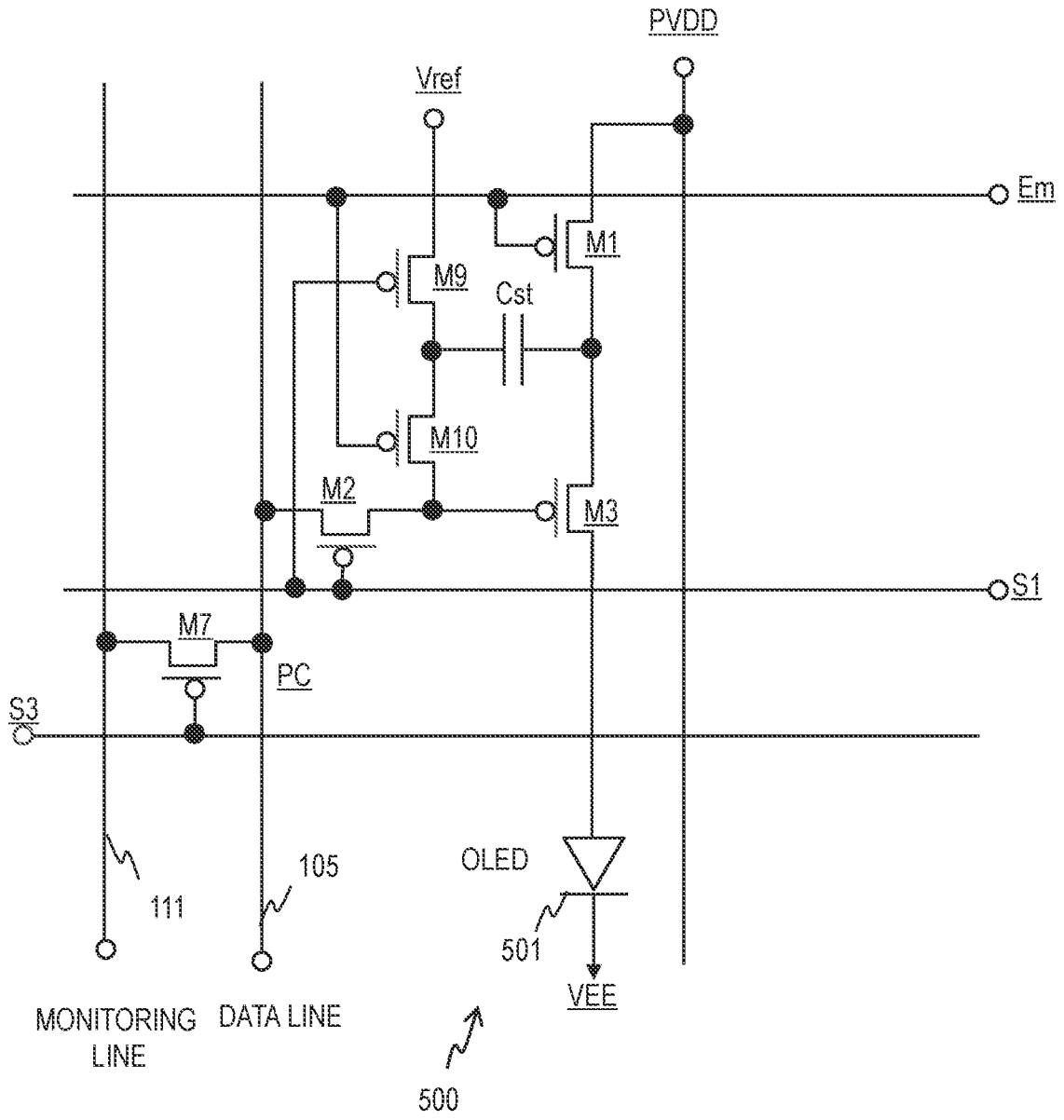
FIG. 22 illustrates still another configuration example of a pixel circuit having a monitoring function.

FIG. 22 illustrates still another configuration example of a pixel circuit 500 having a monitoring function. The transistor M1 is connected between the anode power line PVDD and the driving transistor M3 to control whether the OLED element 501 emits light. The transistor M1 is turned ON/OFF by the light emission control line Em. The transistor M2 supplies the data signal from the data line 105 to the storage capacitor Cst via the transistor M10. The transistor M2 is turned ON/OFF by the selection line S1.

The transistors M9 and M10 operate to set the threshold voltage of the driving transistor M3 to the storage capacitor Cst. The transistor M9 is connected between the reference power line Vref and the storage capacitor Cst and is turned ON/OFF by the selection line S1. The transistor M10 is connected between the storage capacitor Cst and the gate of the driving transistor M3 and is turned ON/OFF by the light emission control line Em. The storage capacitor Cst is connected with a node between the transistors M9 and M10 and a node between the transistor M1 and the driving transistor M3.

The monitoring transistor M7 connects the monitoring line 111 and the data line 105. The monitoring point PC is located on the data line 105. The driver IC 134 measures the voltage of the data line 105 in the data write period to detect failure. The correction data is supplied to the storage capacitor Cst via the monitoring line 111 and the data line 105.

Figure 23:
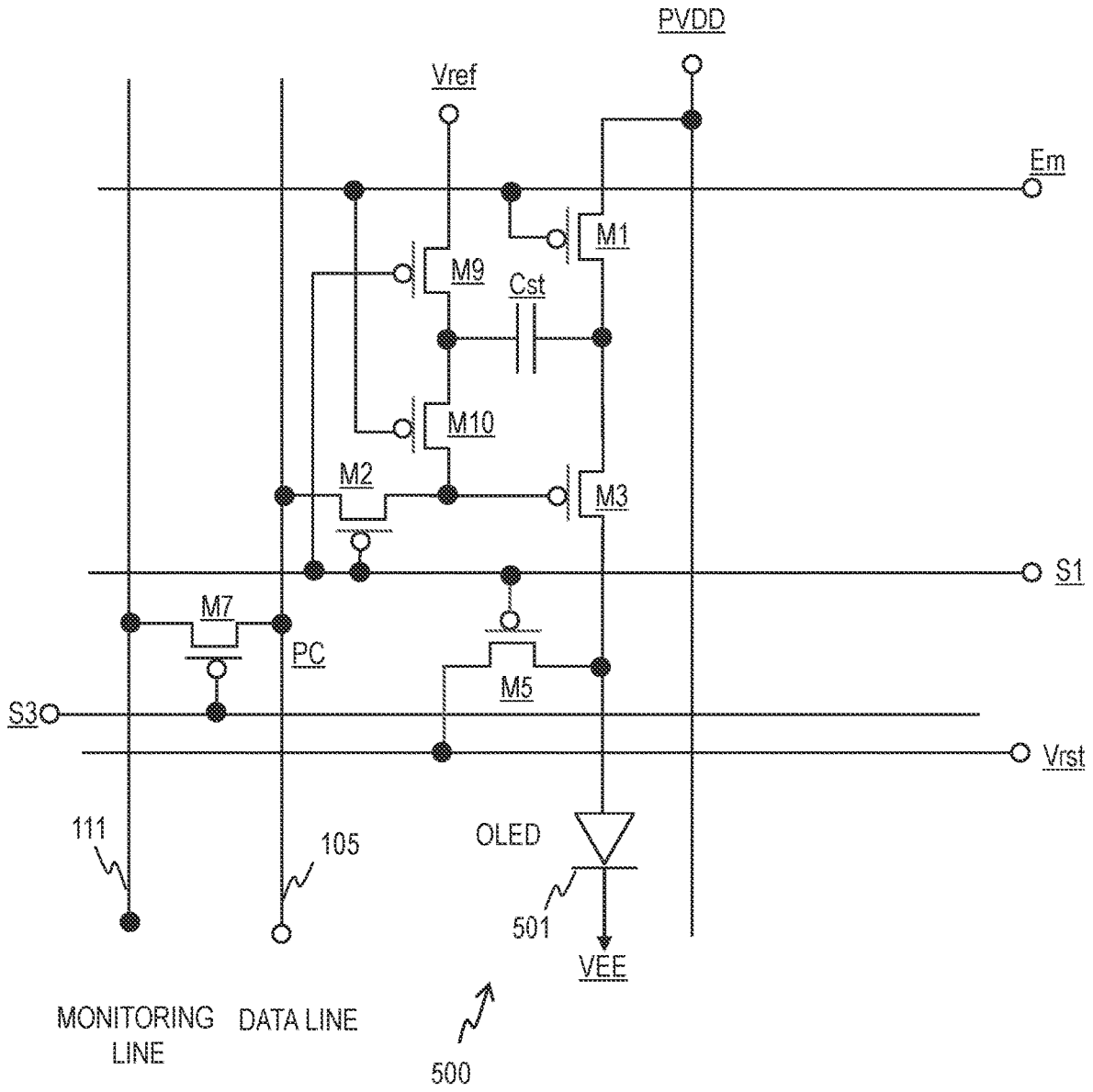
FIG. 23 illustrates still another configuration example of a pixel circuit having a monitoring function.

FIG. 23 illustrates still another configuration example of a pixel circuit 500 having a monitoring function. Compared to the configuration example in FIG. 22, another transistor M5 is added. The transistor M5 connects the anode of the OLED element 501 and the reset power line Vrst. The transistor M5 is turned ON/OFF by the selection line S1. The transistor M5 supplies reset voltage to the anode of the OLED element 501 to reset the voltage at the anode before the OLED element 501 emits light.

Embodiment 4

Figure 24:
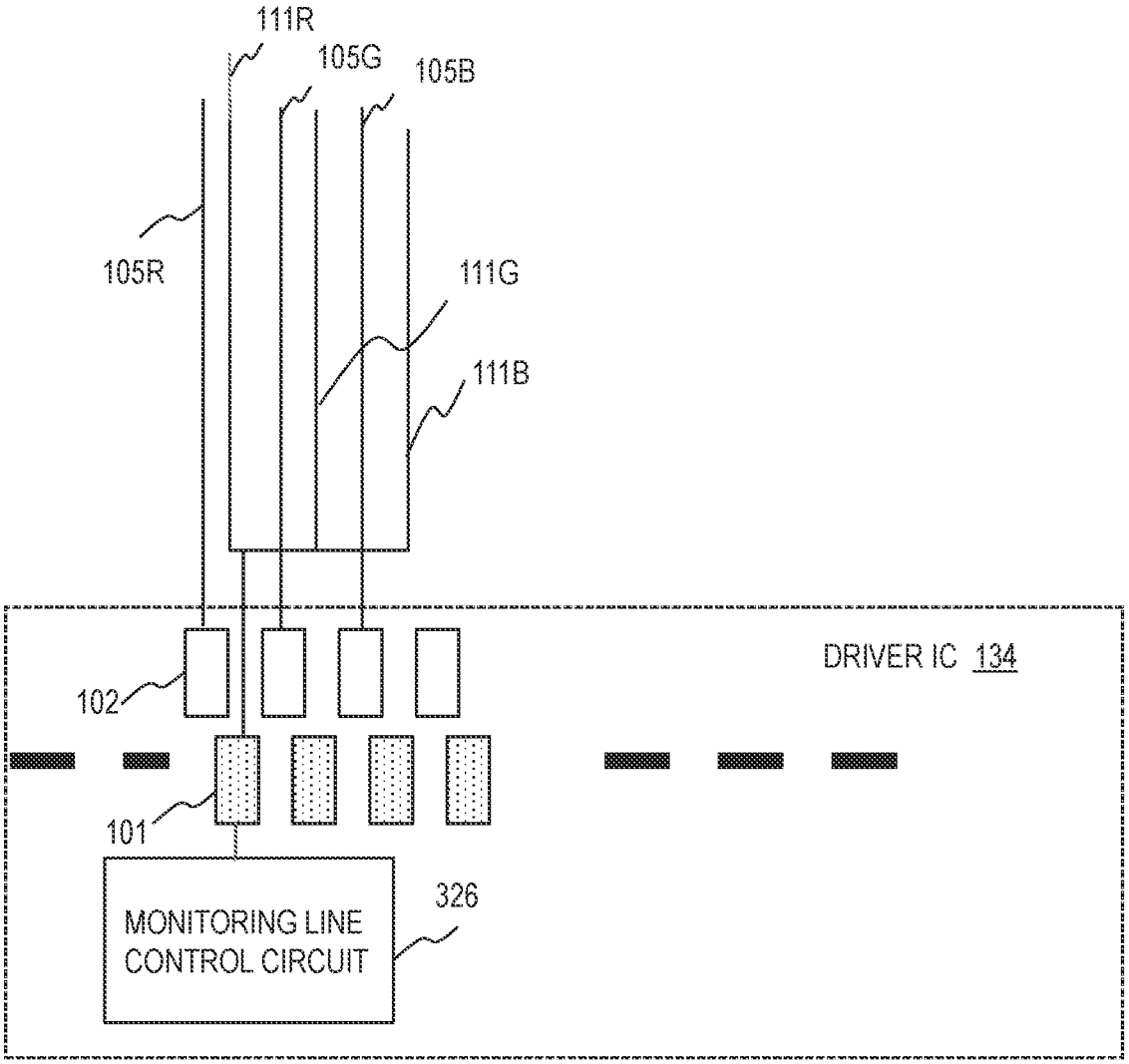
FIG. 24 illustrates a configuration example where a plurality of monitoring lines are connected with one monitoring pad.

Hereinafter, configuration examples to reduce the monitoring pads (monitoring terminals of the driver IC 134) 101 and the monitoring line control circuits in the driver IC 134 are described. FIG. 24 illustrates a configuration example where a plurality of monitoring lines are connected with one monitoring pad. In the example of FIG. 24, the number of monitoring line control circuits 326 in the driver IC 134 is equal to the number of monitoring pads 101; each monitoring line control circuit 326 monitors voltage and further, sends a correction signal through the associated monitoring pad 101.

In the example of FIG. 24, data lines 105R, 105G, and 105B are connected with different data pads 102. The data lines 105R, 105G, and 105B transmit data signals for displaying the same pixel in video data. One monitoring pad 101 is connected with three monitoring lines 111R, 111G, and 111B. The monitoring lines 111R, 111G, and 111B are monitoring lines for monitoring data signal transmission through the data lines 105R, 105G, and 105B, respectively.

When the monitoring line control circuit 326 detects failure with any one of the monitoring lines 111R, 111G, and 111B, it supplies a correction signal of the black level through all monitoring lines 111R, 111G, and 111B. This configuration generates a dark line, irrespective of the image to be displayed. This configuration example reduces the number of monitoring pads 101 and the number of monitoring line control circuits 326 to ⅓.

Figure 25:
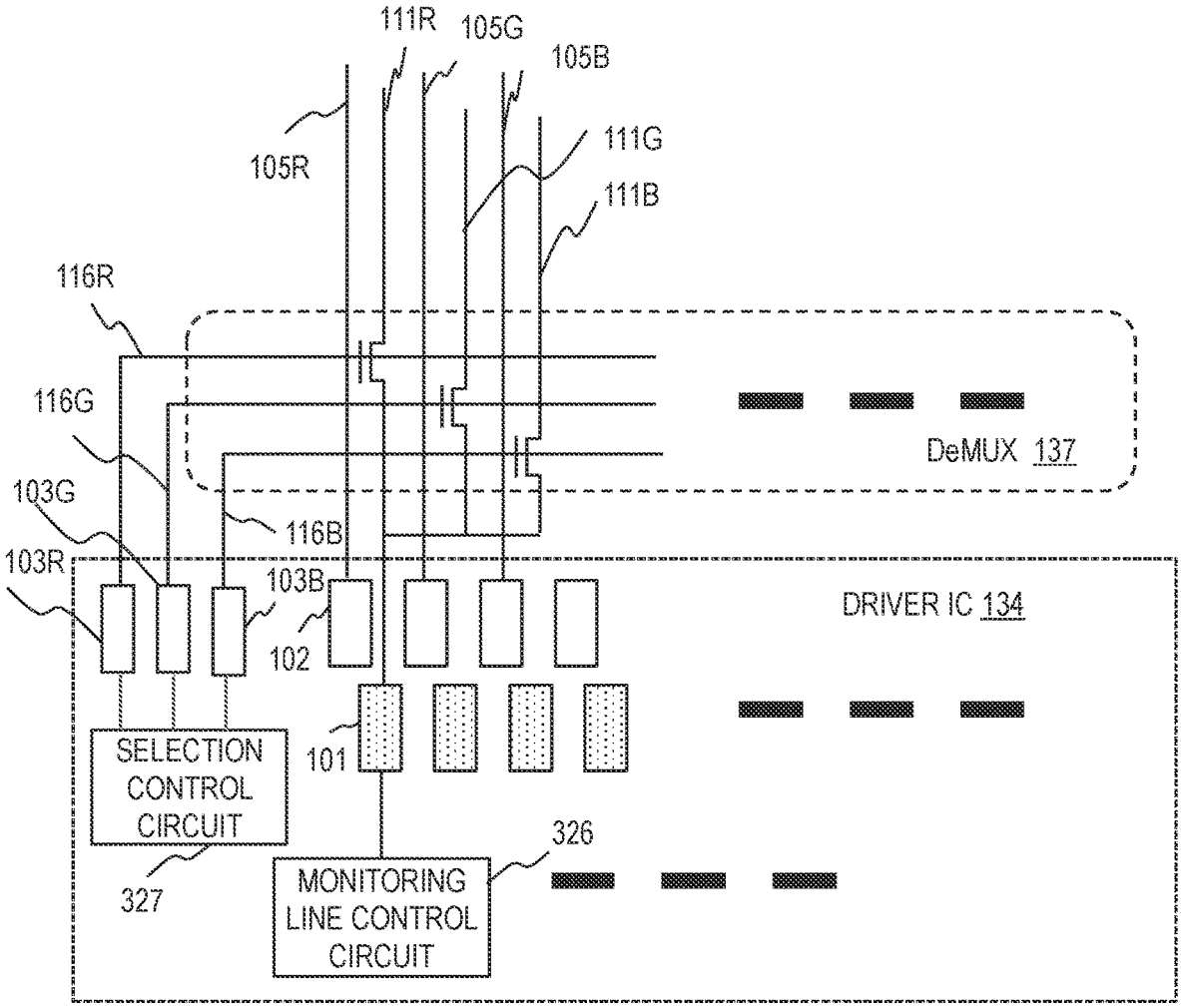
FIG. 25 illustrates a configuration example where a demultiplexer on the substrate serially selects a plurality of monitoring lines connected with one monitoring pad.

FIG. 25 illustrates a configuration example where a demultiplexer on the substrate serially selects a plurality of monitoring lines connected with one monitoring pad. Differences from the configuration example in FIG. 24 are mainly described in the following. A demultiplexer 137 is provided between the monitoring pads 101 and the pixel circuit array 150 (not shown in FIG. 25) on the substrate 100. The demultiplexer 137 includes a plurality of switches. Each switch turns ON/OFF the electric connection between a monitoring line and a monitoring pad.

The driver IC 134 includes a selection control circuit 327. The selection control circuit 327 controls the demultiplexer 137. The selection control circuit 327 serially selects a monitoring line to be ON from the plurality of monitoring lines connected with each one of the monitoring pads. In the example of FIG. 25, the selection control circuit 327 is connected with selection control lines 116R, 116G, and 116B via selection pads 103R, 103G, and 103B, respectively.

The selection control lines 116R, 116G, and 116B control the switches in the demultiplexer 137 for the monitoring lines 111R, 111G, and 111B connected with each monitoring pad. In the example of FIG. 25, the selection control line 116R is connected with all switches for the monitoring lines 111R; the selection control line 116G is connected with all switches for the monitoring lines 111G; and the selection control line 116B is connected with all switches for the monitoring lines 111B.

The selection control circuit 327 selects the selection control lines 116R, 116G, and 116B one by one and outputs a signal for turning ON the associated switches to the selected selection control line to serially connect the monitoring lines 111R, 111B, and 111B of each monitoring pad (all monitoring pads) 101 to their monitoring line control circuit 326. Each monitoring line control circuit 326 controls the three monitoring lines by time-sharing.

This configuration example achieves reduction in the number of monitoring pads and the number of monitoring control circuits and further, allows individual control of the monitoring lines. The number of monitoring lines 111 connected with one monitoring pad 101 can be two or more than three.

Figure 26:
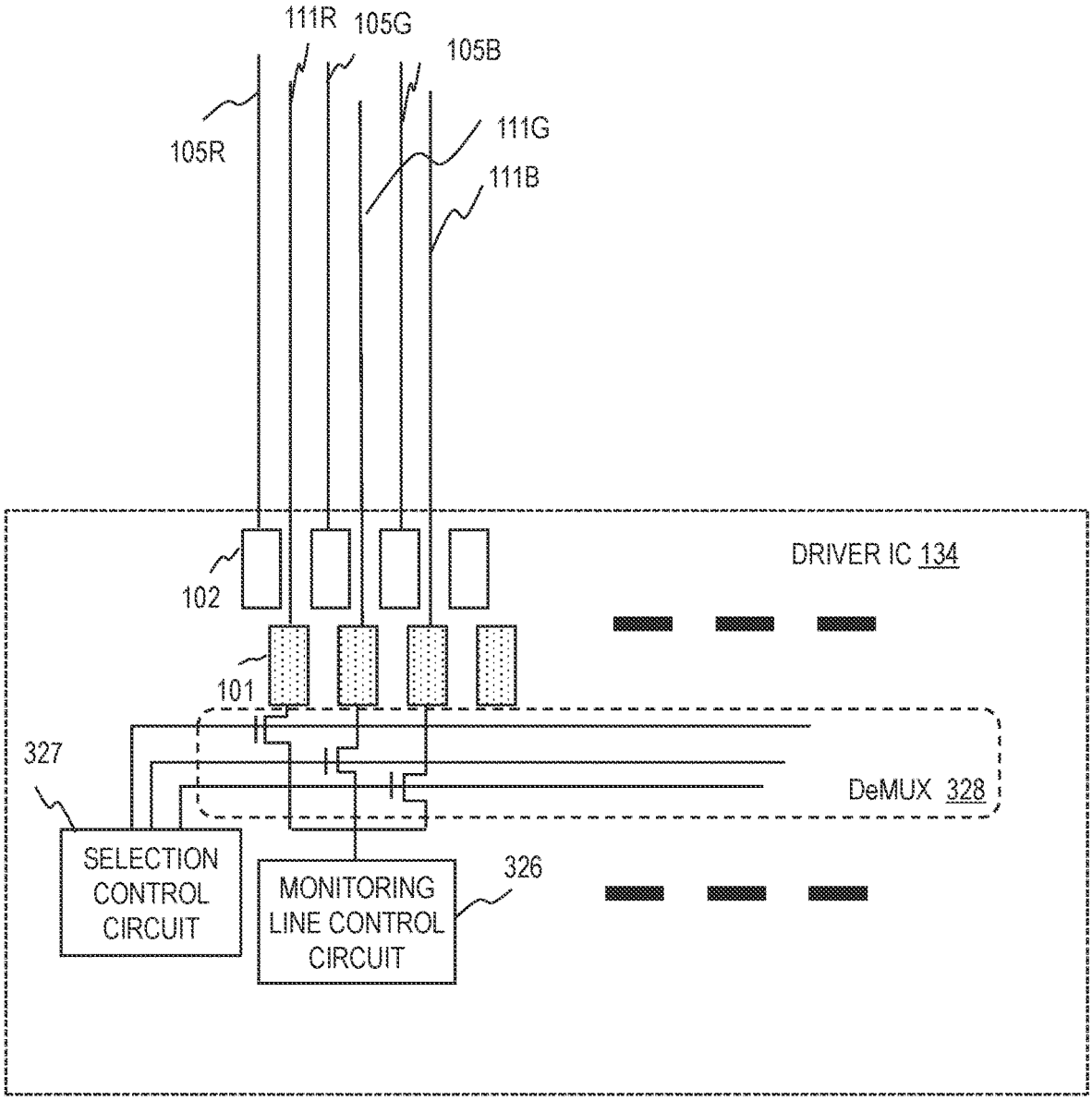
FIG. 26 illustrates a configuration example where a demultiplexer included in the driver IC serially selects a plurality of monitoring lines each connected with one monitoring pad.

FIG. 26 illustrates a configuration example where a demultiplexer included in the driver IC 134 serially selects a plurality of monitoring lines each connected with one monitoring pad. A difference from the configuration example in FIG. 25 is that the demultiplexer 328 for selecting the monitoring lines is incorporated in the driver IC 134. Each monitoring pad 101 is connected with only one monitoring line. The selection control lines and the selection pads on the substrate 100 shown in FIG. 25 are eliminated.

The demultiplexer 328 changes connection of the monitoring line control circuit to a monitoring pad. In this example, each monitoring line control circuit 326 is connected with three monitoring pads 101 and the demultiplexer 328. Each switch of the demultiplexer 328 switches connection/disconnection of each pair of a monitoring pad and a monitoring line with the monitoring line control circuit 326.

The selection control circuit 327 serially selects three monitoring pads connected with each one of all monitoring line control circuits 326. This configuration example achieves reduction in the number of monitoring line control circuits and further allows individual control of the monitoring lines. The number of monitoring lines 111 connected with one monitoring pad 101 can be two or more than three.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device comprising:

a pixel circuit on a substrate;

a data line configured to transmit a data signal for the pixel circuit on the substrate;

a monitoring circuit, and a monitoring line on the substrate, wherein the pixel circuit comprises:

a driving transistor configured to control an amount of electric current supplied to a light-emitting element; and a first switching transistor disposed between the light-emitting element and the driving transistor, the first switching transistor switching between supplying and not supplying the light-emitting element with electric current from the driving transistor, wherein the monitoring circuit monitors a signal at a monitoring point located between the driving transistor and the first switching transistor in the pixel circuit via the monitoring line, and wherein the pixel circuit includes a monitoring transistor disposed between the monitoring line and the monitoring point, and wherein the monitoring transistor is controlled to be ON to supply a monitoring signal from the monitoring point to the monitoring line in a period different from a period in which the data signal is supplied to a gate of the driving transistor via the data line.

2. The display device according to claim 1, wherein the pixel circuit is a first pixel circuit, wherein the monitoring transistor is a first monitoring transistor, and wherein the display device further comprises:

a second pixel circuit comprises a second monitoring transistor having a gate connected with a common selection line that is connected with a gate of the first monitoring transistor; and a second monitoring line connected with the second monitoring transistor.

* * * * *